US009058008B2

(12) United States Patent
Doshida

(10) Patent No.: US 9,058,008 B2
(45) Date of Patent: Jun. 16, 2015

(54) IMAGE FORMING APPARATUS THAT PREVENTS IMAGE DEFECT CAUSED BY OFF-CENTERING OF ROTATING SHAFT OF PHOTOSENSITIVE DRUM

(71) Applicant: CANON KABUSHIKI KAISHA, Tokyo (JP)

(72) Inventor: Takaaki Doshida, Moriya (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 14/205,476

(22) Filed: Mar. 12, 2014

(65) Prior Publication Data

US 2014/0267526 A1 Sep. 18, 2014

(30) Foreign Application Priority Data

Mar. 15, 2013 (JP) ..... 2013-053399

(51) Int. Cl.
*B41J 2/385* (2006.01)
*G03G 15/01* (2006.01)
*G03G 15/00* (2006.01)

(52) U.S. Cl.
CPC ..... *G03G 15/757* (2013.01); *G03G 15/5008* (2013.01)

(58) Field of Classification Search
CPC . G03G 15/167; G03G 15/1615; G03G 15/50; G03G 15/505; G03G 15/5008; G03G 15/757; G03G 2215/0129
USPC ..... 347/116, 140, 154, 224, 225, 228, 240, 347/251; 399/236, 279, 281, 284, 297, 301, 399/302, 308
See application file for complete search history.

(56) References Cited

U.S. PATENT DOCUMENTS 5,881,346 A * 3/1999 Mori et al. ..... 399/301
6,816,178 B2 * 11/2004 Yamada et al. ..... 347/116
8,843,037 B2 * 9/2014 Ogawa et al. ..... 399/301

FOREIGN PATENT DOCUMENTS

JP 08-099437 A 4/1996
JP 2002-333752 A 11/2002
JP 2007-156194 A 6/2007

* cited by examiner

*Primary Examiner* — Hai C Pham
(74) *Attorney, Agent, or Firm* — Rossi, Kimms & McDowell LLP

(57) ABSTRACT

An image forming apparatus that is capable of forming an electrostatic latent image on the surface of a photosensitive member with high position accuracy even when the shaft of the photosensitive member is off-centered. In the apparatus, exposure devices form electrostatic latent images on respective photosensitive drums, and developing devices develop the electrostatic latent images. An intermediate transfer belt rotates in contact with the photosensitive drums. A rotary encoder detects a rotational speed of a drum shaft of each photosensitive drum. An amount of off-centering of the drum shaft is detected, and a correction coefficient for correcting positional displacement of electrostatic latent images is calculated. A control unit corrects timing of exposure using the calculated correction coefficient, and controls the exposure device to form the image on the photosensitive drum based on the corrected timing of exposure.

10 Claims, 23 Drawing Sheets

FIG. 22

| ZEBRA PITCH NO. | ASSOCIATED DRUM SURFACE ADDRESS LOCATION | CORRECTION COEFFICIENT |
|---|---|---|
| $T_1$ | $200+\alpha - 200+\alpha+S_1$ | $Y_1$ |
| $T_2$ | $200+\alpha+S_1 - 200+\alpha+S_2$ | $Y_2$ |
| $T_3$ | $200+\alpha+S_2 - 200+\alpha+S_3$ | $Y_3$ |
| $T_4$ | $200+\alpha+S_3 - 200+\alpha+S_4$ | $Y_4$ |
| ⋮ | ⋮ | ⋮ |
| $T_N$ | $200+\alpha+S_{N-1} - 200+\alpha+S_N$ | $Y_N$ |

| OFFSET |
|---|
| $200+\alpha$ |

IMAGE FORMING APPARATUS THAT PREVENTS IMAGE DEFECT CAUSED BY OFF-CENTERING OF ROTATING SHAFT OF PHOTOSENSITIVE DRUM

BACKGROUND OF THE INVENTION

1. Field of the Invention

The present invention relates to an image forming apparatus that is capable of preventing an image defect caused by variation in surface speed of a photosensitive drum due to off-centering of a rotating shaft of the photosensitive drum.

2. Description of the Related Art

In electrophotographic image forming apparatuses including a copy machine, a multifunction peripheral, and a facsimile machine, photosensitive drums and an intermediate transfer belt which carry toner images are required to be driven at a constant surface speed. This is because, first, variation in the surface speed of the photosensitive drum causes deviation of a laser irradiation position from an original proper position to be irradiated. Secondly, in a primary transfer process for transferring a toner image formed on the photosensitive drum onto the intermediate transfer belt, if there occurs an AC current-like variation in the difference of surface speed between the photosensitive drum and the intermediate transfer belt, the position of the toner image transferred onto the intermediate transfer belt deviates from the original proper position where the toner image is to be transferred. That is, in a case where the photosensitive drum and the intermediate transfer belt are not driven at a constant surface speed, an image defect, such as image color shift caused by positional displacement between images of respective colors, or a periodical positional displacement called banding, occurs on an image which is finally formed on a recording sheet.

To overcome the above-mentioned problem, in the control of driving the photosensitive drum and the intermediate transfer belt, the feedback-control of the speed of a motor as a drive source is performed, based on results of detection by various speed detection sensors and the like, whereby highly-accurate speed constancy is ensured. Further, as the drive motor, a brushless DC motor (hereinafter referred to as the "BLDC motor") is often used because of low-cost, quietness, and high efficiency. In recent years, for the speed feedback control using the BLDC motor, a method is employed in which a rotary encoder is arranged on a drum shaft, and the CPU controls the BLDC motor to rotate the drum shaft at a constant speed.

However, in the above-mentioned speed feedback control, although the rotational speed of the drum shaft is detected, the surface speed of the photosensitive drum is not detected, and hence there is a case where the surface speed of the photosensitive drum fails to be constant e.g. due to off-centering of the drum shaft and low accuracy of the diameter of a roller. Similarly, in the intermediate transfer belt as well, the same problem is caused e.g. by off-centering of a rotating shaft of an intermediate transfer belt-driving roller which drives the intermediate transfer belt, low accuracy of the diameter of the roller, and variation in thickness of the intermediate transfer belt.

On the other hand, factors causing the image defects include mutual interference caused by friction between the surface of the photosensitive drum and the transfer surface of the intermediate transfer belt. This is caused because a speed variation occurring in one of the photosensitive drum and the intermediate transfer belt has influence on the other. As another factor, there may be mentioned an occurrence of an unplanned change in load on the intermediate transfer belt during secondary transfer of a toner image carried on the intermediate transfer belt onto a recording sheet, especially when the recording sheet is thick paper. This causes a high-frequency speed variation, and this speed variation causes positional displacement in the primary transfer. As described above, there are various factors causing the image defects, and it is very difficult to eliminate all of the factors causing the defects.

To cope with this, as described in Japanese Patent Laid-Open Publication No. 2002-333752, there has been developed a technique in which an image transfer roller (which corresponds to the intermediate transfer belt) causes an image roller (which corresponds to the photosensitive drum) to be friction-driven. According to this technique, the following advantages can be obtained: First, images on the photosensitive drums become an image on the intermediate transfer belt, and hence by forming the image on the intermediate transfer belt with reference to respective positions on the photosensitive drums, the influence of irregular rotation of the photosensitive drums is reduced. Further, secondly, even when the speed of the intermediate transfer belt is varied e.g. due to an impact generated upon entrance of a recording sheet into a secondary transfer section of the intermediate transfer belt, matching of respective images on the photosensitive drums with the image on the intermediate transfer belt can be ensured, and hence image defects in the primary transfer are less liable to occur.

However, to obtain the first advantage, it is important to form an image with reference to the rotational position of each photosensitive drum. To this end, as described in Japanese Patent Laid-Open Publication No. H08-99437, there has been developed a technique for performing exposure control in synchronism with an amount of rotational movement of the drum (see e.g. Japanese Patent Laid-Open Publication No. H08-99437). Further, there has also been developed a technique for directly detecting a speed of the surface of the photosensitive drum (see e.g. Japanese Patent Laid-Open Publication No. 2007-156194).

The technique disclosed in Japanese Patent Laid-Open Publication No. H08-99437 is for performing the exposure control in synchronism with an amount of rotational movement of the photosensitive drum. However, in this technique, assuming that the rotating shaft is arranged on the center position of the photosensitive drum and that the diameter of the photosensitive drum is accurately the same as designed, it is possible to obtain a value equivalent to that obtained by detecting an amount of surface movement on the photosensitive drum, which makes it possible to form an electrostatic latent image on the photosensitive drum without positional displacement. However, in actuality, the rotating shaft of the photosensitive drum is very slightly off-centered, and even if the photosensitive drum is rotated at a constant speed, the amount of surface movement is not constant due to adverse influence of off-centering of the shaft. Therefore, even when the exposure control is performed in synchronism with the amount of rotational movement of the photosensitive drum, an electrostatic latent image formed on the photosensitive drum may be positionally displaced.

Further, the technique disclosed in Japanese Patent Laid-Open Publication No. 2007-156194 has a problem that the use of a surface speed sensor for detecting the surface speed of the photosensitive drum increases the cost. Particularly, in a case where a surface speed sensor for detecting a scale formed on the drum surface is used, thermal deformation of the drum surface, scraping-off of the surface, etc. have influence on the result of detection, and it is difficult to cope with this influence. Besides these, there has also been proposed a method of controlling exposure in synchronism with a rotating member brought into contact with the surface of the photosensitive drum, but this cannot cope with aging of the rotating member, including scraping-off of the surface of the rotating member.

SUMMARY OF THE INVENTION

The present invention provides an image forming apparatus that is capable of forming an electrostatic latent image on the surface of a photosensitive drum with high position accuracy even when the rotating shaft of the photosensitive drum is off-centered.

The present invention provides image forming apparatus comprising an image bearing member that is rotatable, an exposure unit configured to form an electrostatic latent image on the image bearing member, a development unit configured to develop the electrostatic latent image, an intermediate transfer member configured to rotate in a state in contact with the image bearing member, a speed detection unit configured to detect a rotational speed of a rotating shaft of the image bearing member, an off-centering amount-detecting unit configured to detect an amount of off-centering of the rotating shaft, a calculation unit configured to calculate a correction coefficient for correcting positional displacement of an electrostatic latent image formed on a surface of the image bearing member caused by off-centering of the rotating shaft, and a control unit configured to control the exposure unit to form an electrostatic latent image, which is corrected for the positional displacement caused by the off-centering of the rotating shaft, using the correction coefficient, on the surface of the photosensitive drum, wherein the off-centering amount-detecting unit includes a rotating member configured to be brought into contact with the surface of the photosensitive drum, and is friction-driven for rotation by rotation of the photosensitive drum, a rotation detection unit configured to detect rotation of the rotating member, and a pattern detection unit configured to detect a developed pattern formed using the development unit by developing a latent image pattern repeatedly formed on the surface of the photosensitive drum according to one revolution of the rotating member, and calculates the amount of off-centering of the rotating shaft using a detection time period during which the developed pattern is detected, a detection value output from the speed detection unit, which is associated with the detection time period, and a pitch distance of the developed pattern.

According to the present invention, image data is corrected using a correction coefficient for correcting an amount of off-centering, which is associated with each area of the image data on the surface of the photosensitive drum, and an exposure device is controlled using the corrected image data. This makes it possible to form an electrostatic latent image on the surface of the photosensitive drum with high position accuracy even when the rotating shaft of the photosensitive member is off-centered.

Further features of the present invention will become apparent from the following description of exemplary embodiments (with reference to the attached drawings).

BRIEF DESCRIPTION OF THE DRAWINGS

FIG. 22 is a correspondence table showing correspondence between address locations on the surface of the photosensitive drum and respective radius correction coefficients associated with the address locations.

DESCRIPTION OF THE EMBODIMENTS

The present invention will now be described in detail below with reference to the accompanying drawings showing embodiments thereof.

Figure 1:
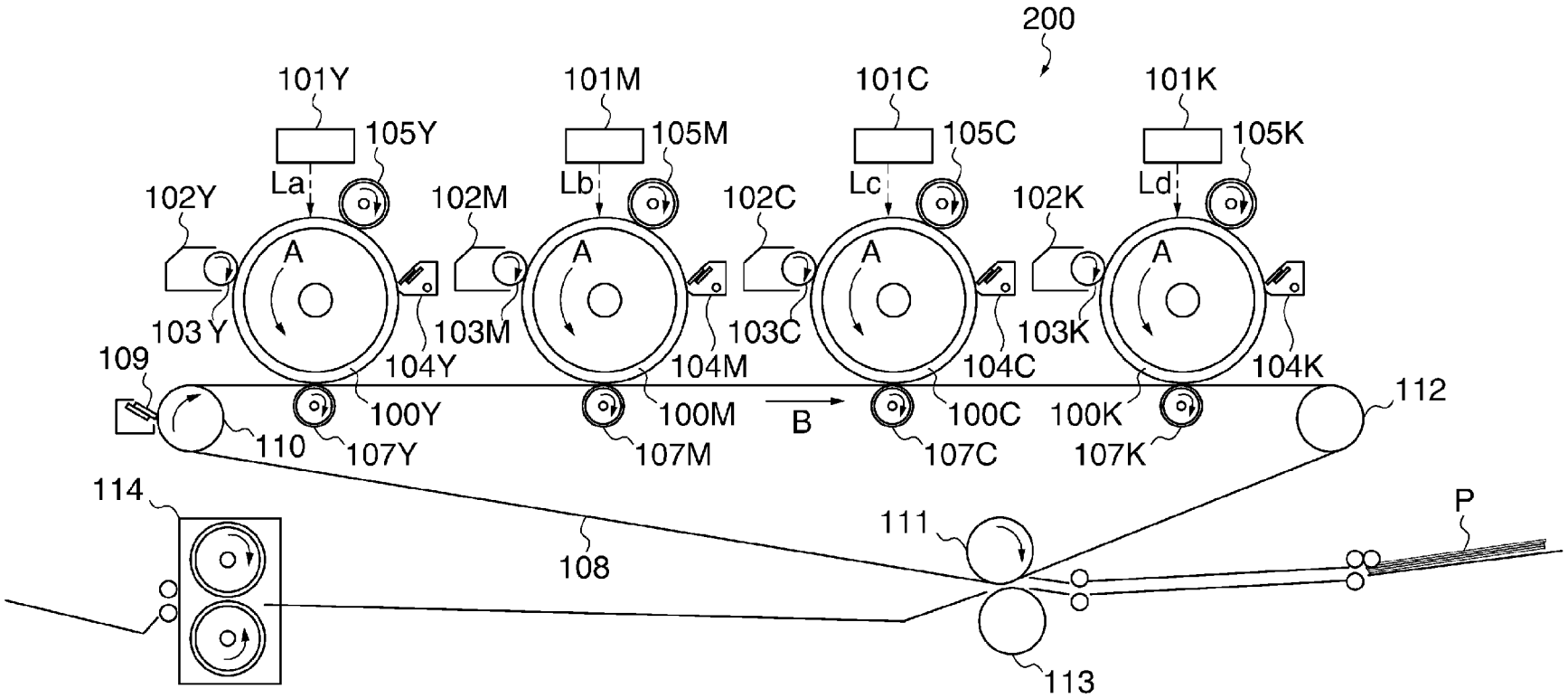
FIG. 1 is a schematic cross-sectional view of essential parts of an image forming apparatus according to a first embodiment of the present invention.

FIG. 1 is a schematic cross-sectional view of essential parts of an image forming apparatus according to a first embodiment of the present invention. This image forming apparatus, denoted by reference numeral 200, is an electrophotographic color digital copy machine. The image forming apparatus 200 is not necessarily required to be a copy machine, but it may be a multifunction peripheral or a facsimile machine, and further may be a monochrome digital copy machine, multifunction peripheral, or facsimile machine, instead of a color one.

Referring to FIG. 1, the image forming apparatus 200 has four image forming units, by way of example, which are arranged in a substantially horizontal direction and are respectively provided with photosensitive drums 100Y, 100M, 100C, and 100K associated with respective colors of yellow (Y), magenta (M), cyan (C), and black (K). The photosensitive drums 100Y to 100K as image bearing members are rotatable, and each rotate in a direction indicated by an arrow A in FIG. 1.

The image forming units include not only the photosensitive drums 100Y to 100K, but also primary electrostatic chargers 105Y, 105M, 105C, and 105K, exposure devices 101Y, 101M, 101C, and 101K, and developing devices 102Y, 102M, 102C, and 102K, which are associated therewith, respectively. The developing devices 102Y to 102K include developing sleeves 103Y, 103M, 103C, and 103K, which are associated therewith, respectively. Further, the image forming units include cleaners 104Y, 104M, 104C, and 104K, which are associated with the photosensitive drums 100Y to 100K, respectively.

The primary electrostatic chargers 105Y to 105K uniformly charge surfaces of the respective associated photosensitive drums 100Y to 100K. Further, the exposure devices 101Y to 101K expose the charged surfaces of the photosensitive drums 100Y to 100K based on image information to thereby form electrostatic latent images, respectively.

The developing devices 102Y to 102K develop the electrostatic latent images formed on the surfaces of the respective associated photosensitive drums 100Y to 100K using the developing sleeves (sleeve members) 103Y to 103K containing chromatic color toner to thereby form toner images of the respective colors.

Primary transfer rollers 107Y, 107M, 107C, and 107K are arranged in a manner opposed to the photosensitive drums 100Y to 100K, respectively. An intermediate transfer belt (denoted as "ITB" in figures) 108 as an intermediate transfer member, which is in the form of an endless belt, is provided such that it is conveyed through between the photosensitive drums 100Y to 100K and the primary transfer rollers 107Y to 107K.

The intermediate transfer belt 108 is stretched around a plurality of stretching rollers 110 to 112 and is brought into contact with the surfaces of the photosensitive drums 100Y to 100K, respectively. The stretching roller 110 is also referred to as the intermediate transfer belt drive roller, and a stretching roller 111 is also referred to as the secondary transfer inner roller. The intermediate transfer belt 108 rotates in a direction indicated by an arrow B in FIG. 1. The toner images formed on the respective surfaces of the photosensitive drums 100Y to 100K are sequentially transferred onto the intermediate transfer belt 108 in superimposed relation to thereby form a color image.

The stretching roller 110 is a drive roller for driving the intermediate transfer belt 108, and also functions as a tension roller which controls tension of the intermediate transfer belt 108 to a constant level. The stretching roller 111 is the secondary transfer inner roller which forms a nip at a contact location where it is in contact with a secondary transfer outer roller 113 opposed thereto.

The toner image on the intermediate transfer belt 108 is transferred onto a sheet P at the contact location where the secondary transfer inner and outer rollers 111 and 113 are in contact. The sheet P having the toner image transferred thereon is conveyed into a fixing device 114 disposed at a downstream location, and the toner image is fixed on the sheet P by the fixing device 114. The sheet P having the toner image fixed thereon is conveyed out of the fixing device 114, and is discharged to the outside of the image forming apparatus 200. On the other hand, residual toner, paper dust and the like remaining on the intermediate transfer belt 108 after completion of the secondary transfer are cleaned off by a cleaning device 109, whereby the intermediate transfer belt 108 is repeatedly used in the image formation process.

Figure 2:
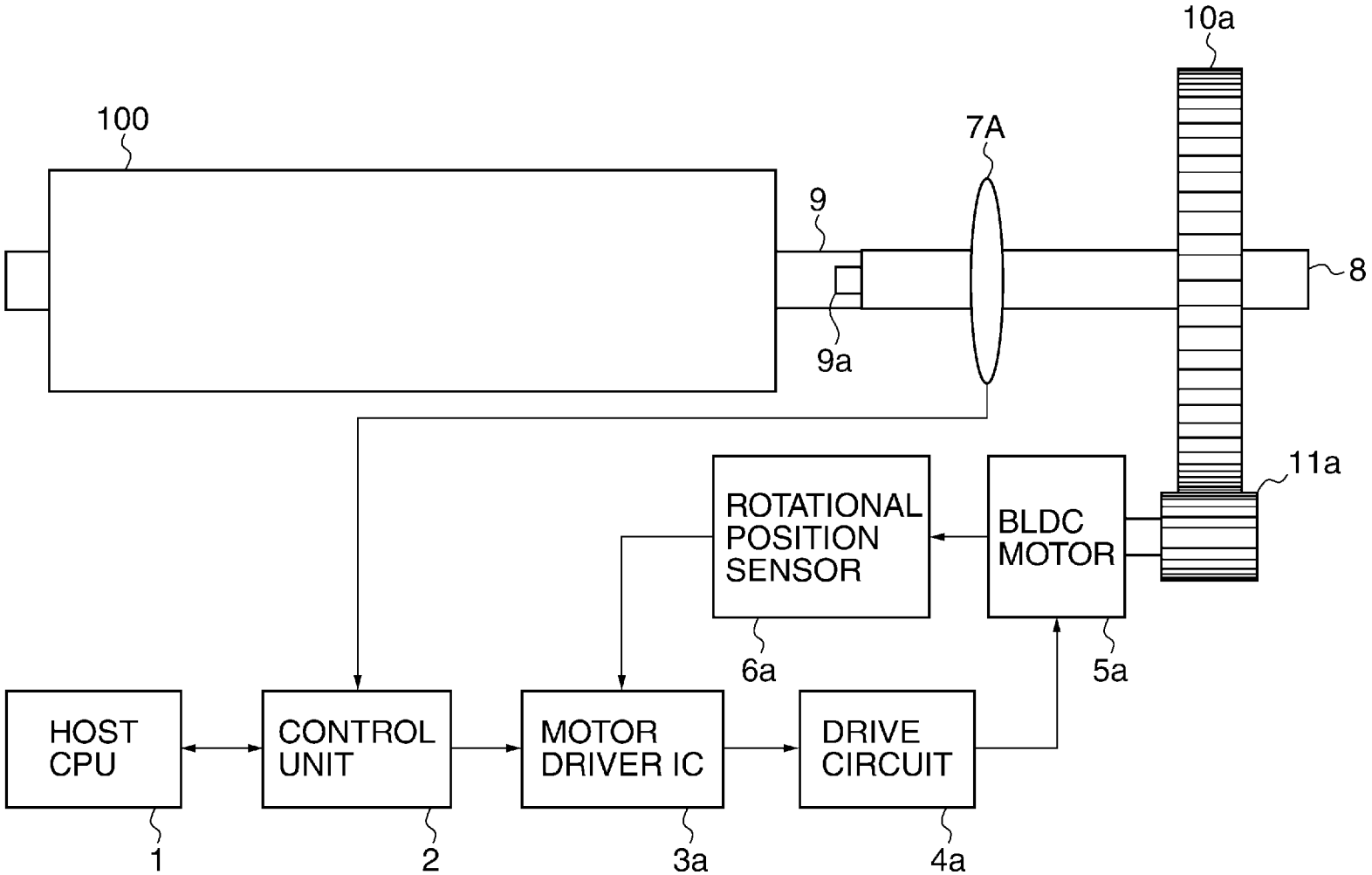
FIG. 2 is a schematic diagram showing the electrical and mechanical arrangement for driving a photosensitive drum appearing in FIG. 1.

FIG. 2 is a diagram showing the electrical and mechanical arrangement for driving the photosensitive drum 100 appearing in FIG. 1.

Referring to FIG. 2, a drum shaft 9 of the photosensitive drum 100 is mechanically connected to a reduction gear shaft 8 via a coupling 9*a*. The reduction gear shaft 8 is engaged with a motor shaft gear 11*a* via a reduction gear 10*a*. The reduction gear shaft 8 and the reduction gear 10*a* are fixedly connected by a joint mechanism, not shown. A rotary encoder 7A for detecting a rotational speed of the reduction gear shaft 8 is fitted on the reduction gear shaft 8, and a rotational speed detection value detected by the rotary encoder 7A is used e.g. for calculating assist torque and detecting off-centering of the drum shaft 9.

The photosensitive drum 100 is provided with, as control components therefor, a host CPU 1, a controller 2, a motor driver IC 3*a*, a drive circuit 4*a*, a rotational position sensor 6*a*, and a BLDC motor 5*a*. The host CPU 1 collectively controls the start and stop of respective processes (for charging, exposure, development, primary transfer process, etc.) in an image formation process, and other various setting values. Angular speed feedback control based on values detected from the rotary encoder 7A is performed in an assist torque calculation process, and hence the controller 2 is provided with a PID controller therein. The controller 2 outputs command signals received from the host CPU 1, such as a drive on/off signal, a target speed signal, a register setting value signal, and a PWM value signal, to the motor driver IC 3*a* as control signals. Further, the controller 2 performs computations for speed control based on signals from the rotary encoder 7A. The motor driver IC 3*a* controls, based on a control signal output from the controller 2 and a rotational position signal output from the rotational position sensor 6, the drive circuit 4*a* to switch the phase currents to be supplied to the BLDC motor 5*a* and adjust the current amounts of the same. The BLDC motor 5*a* drives the drum shaft 9 for rotation via the motor shaft gear 11*a* and the reduction gear 10*a*. That is, a driving force from the BLDC motor 5*a* as a first drive source is transmitted to the reduction gear shaft 8 in a state in which the speed thereof is reduced by meshing between the motor shaft gear 11*a* and the reduction gear 10*a*, and is transmitted to the drum shaft 9 and the photosensitive drum 100 via the coupling 9*a*. The BLDC motor 5*a* is e.g. a low-inertia brushless DC motor.

Figure 3:
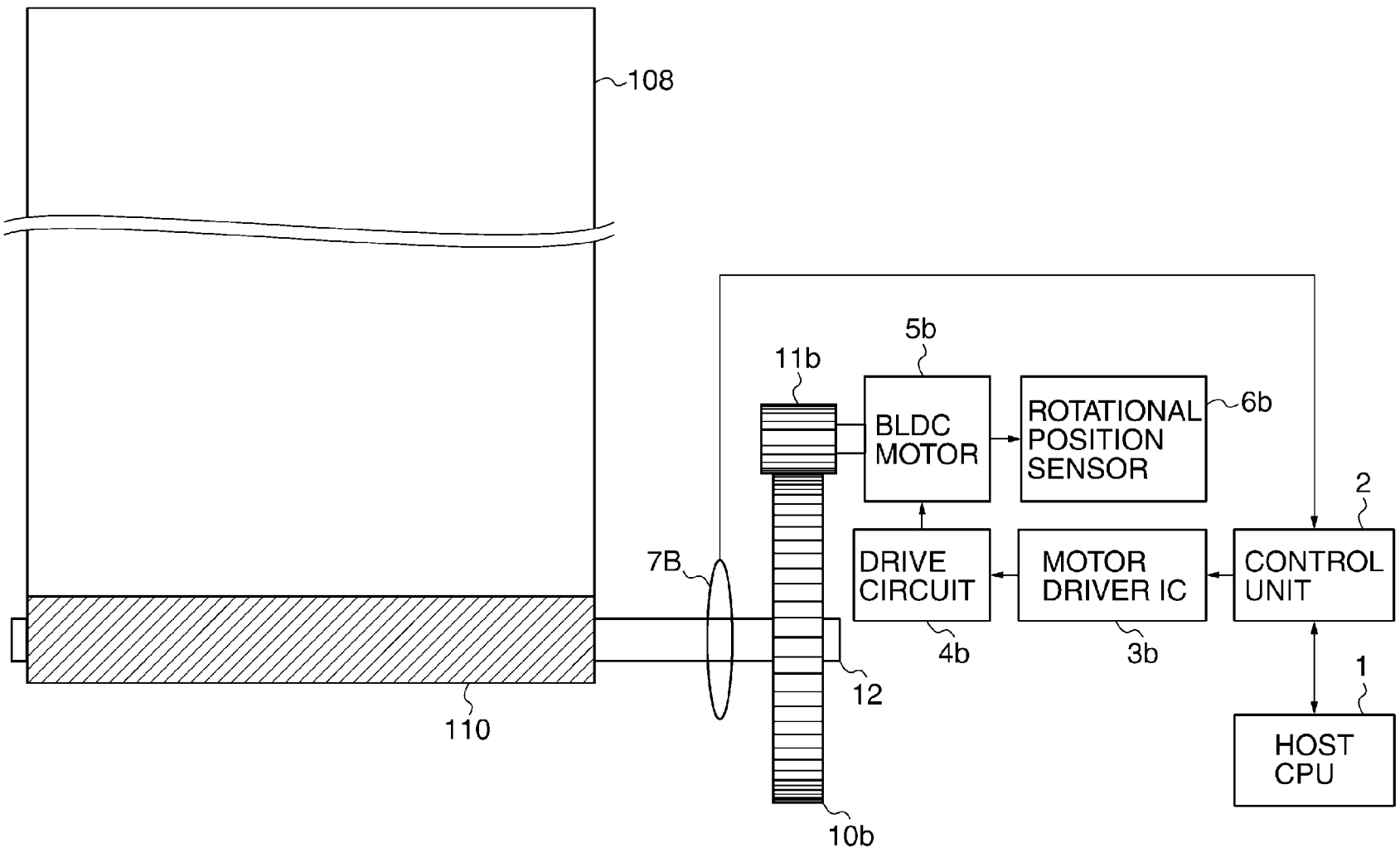
FIG. 3 is a schematic diagram showing the electrical and mechanical arrangement for driving an intermediate transfer belt appearing in FIG. 1.

FIG. 3 is a diagram showing the electrical and mechanical arrangement for driving the intermediate transfer belt 108 appearing in FIG. 1.

Referring to FIG. 3, the intermediate transfer belt 108 is driven by driving the intermediate transfer belt drive roller 110 for rotation, which is disposed in contact with the inner side of the intermediate transfer belt 108. An intermediate transfer belt roller shaft 12 of the intermediate transfer belt drive roller 110 is engaged with a motor shaft gear 11*b* via a reduction gear 10*b*. The intermediate transfer belt roller shaft 12 and the reduction gear 10*b* are fixedly connected by a joint mechanism, not shown. A rotary encoder 7B for detecting a rotational speed of the intermediate transfer belt roller shaft 12 is fitted on the intermediate transfer belt roller shaft 12.

The intermediate transfer belt 108 is provided with, as control components therefor, the host CPU 1, the controller 2, a motor driver IC 3*b*, a drive circuit 4*b*, a rotational position sensor 6*b*, and a BLDC motor 5*b*. The intermediate transfer belt 108 is driven according to the angular speed feedback control based on a detection value detected by the rotary encoder 7B. Note that in the angular speed feedback control, the PID controller controls the speed such that a difference between a target speed (hereinafter referred to as the "process speed") instructed by the host CPU 1 and a value obtained by converting the detection value from the rotary encoder 7B to a process speed becomes small.

Similarly to the case of the photosensitive drums 100, a driving force from the BLDC motor 5*b* as a second drive source for driving the intermediate transfer belt 108 is transmitted to the intermediate transfer belt drive roller 110 via the intermediate transfer belt roller shaft 12 in a state in which the speed thereof is reduced by meshing between the motor shaft gear 11*b* and the reduction gear 10*b*. The electrical arrangement is the same as that for driving each photosensitive drum 100.

Next, the internal configuration of the controller 2 appearing in FIGS. 2 and 3 will be described.

Figure 4:
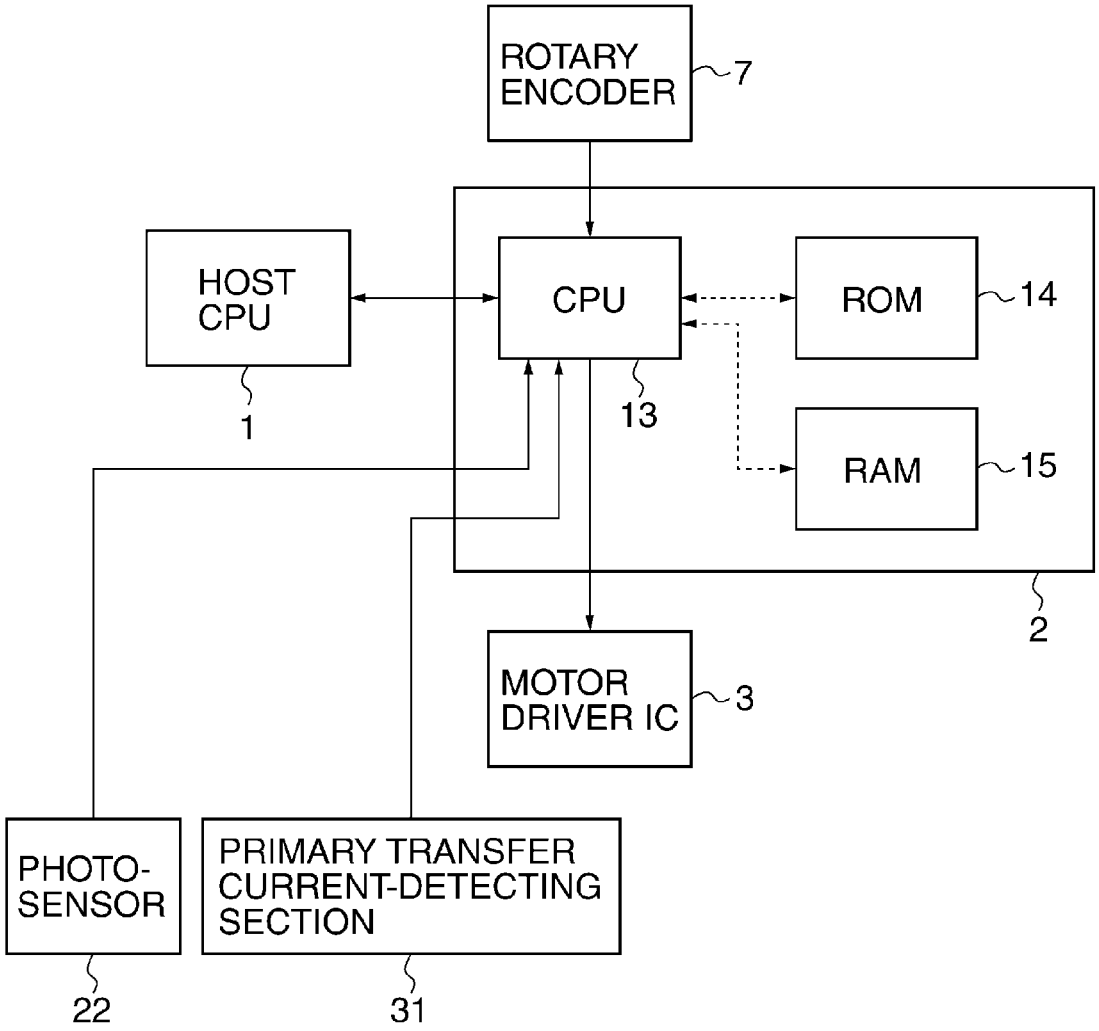
FIG. 4 is a diagram showing the internal configuration of a control unit appearing in FIGS. 2 and 3.

FIG. 4 is a diagram showing the internal configuration of the controller 2 appearing in FIGS. 2 and 3.

Referring to FIG. 4, the controller 2 mainly comprises a CPU 13, and a ROM 14 and a RAM 15 each connected to the CPU 13. The CPU 13 which drivingly controls the photosensitive drums 100 performs the angular speed feedback control using the PID controller (not shown) based on the detection values from the rotary encoder 7A when calculating assist torque. Further, during the image formation process, the CPU 13 is configured to output a PWM signal at a predetermined duty factor corresponding to the calculated assist torque to the motor driver IC 3*a* or 3*b*.

The CPU 13 is further configured to perform detection of primary transfer current based on output from a primary transfer current sensor 31, and detection of a marking 20*a* of a rotor 20 (see FIGS. 15 and 16) based on output from a photosensor 22, described hereinafter, and these detection results are used for detecting an off-center component of the drum shaft 9. Detection of the off-center component of the drum shaft 9 will be described in detail hereinafter.

In the image forming apparatus shown in FIG. 1, each photosensitive drum 100 is configured to be friction-driven by the intermediate transfer belt 108 such that it is rotated in a manner following the intermediate transfer belt 108.

The friction driving refers to driving of the photosensitive drums 100 using the frictional force generated between the intermediate transfer belt 108 and the photosensitive drums 100, such that the photosensitive drums 100 follow the intermediate transfer belt 108. More accurately, the friction driving is refers to driving the photosensitive drums 100 in a state in which the surface speed of the intermediate transfer belt 108 and that of the photosensitive drums 100 always coincide with each other, by the intermediate transfer belt 108 which causes the photosensitive drums 100 to be rotated together therewith.

Figure 5:
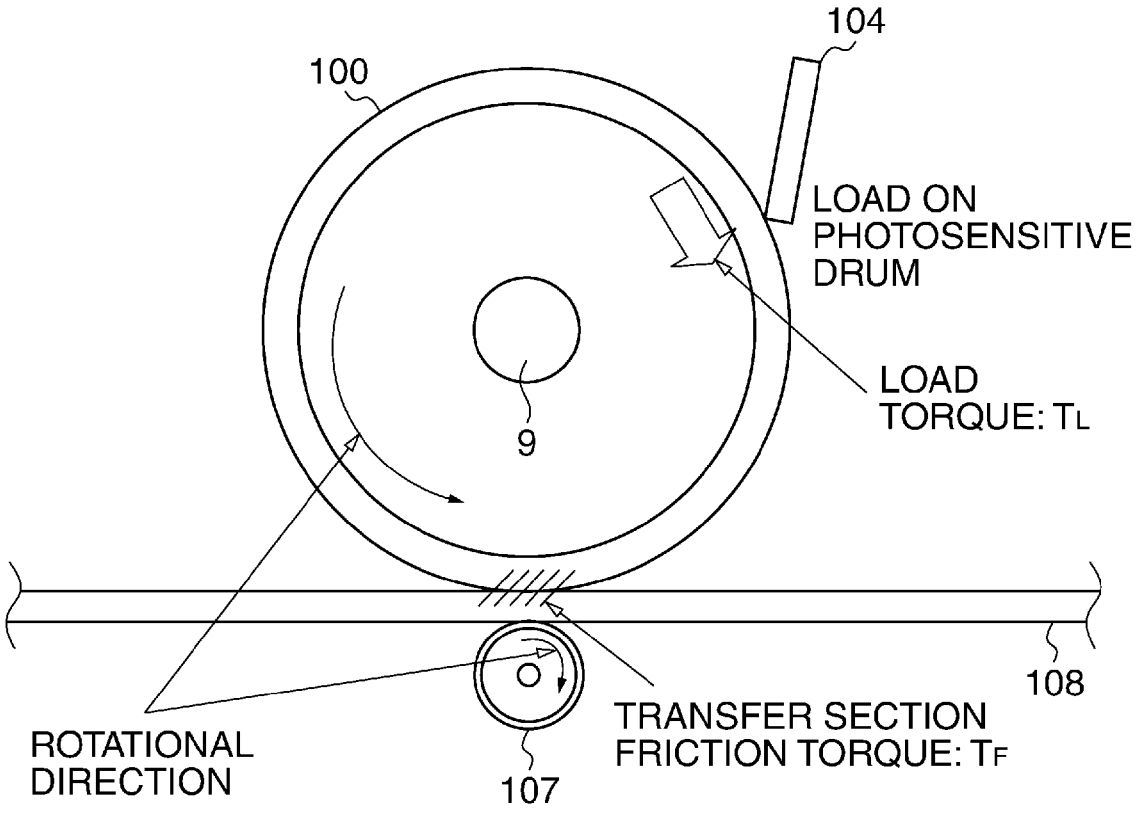
FIG. 5 is a diagram useful in explaining a friction drive system in which the photosensitive drum appearing in FIG. 1 is friction-driven for rotation by the intermediate transfer belt.

FIG. 5 is a diagram useful in explaining a friction drive system in which each photosensitive drum 100 appearing in FIG. 1 is friction-driven for rotation by the intermediate transfer belt 108.

Referring to FIG. 5, load torque $T_L$ on the drum shaft 9 and transfer section friction torque $T_F$, which are generated when the photosensitive drum 100 is driven at a predetermined process speed, are visually represented. One surface of the intermediate transfer belt 108 is brought into contact with the photosensitive drum 100 to form a friction-driving portion. The primary transfer roller 107 is disposed at a location opposed to the photosensitive drum 100 across the intermediate transfer belt 108.

The friction torque $T_F$ generated at the primary transfer section where the intermediate transfer belt 108 and the photosensitive drum 100 are in contact represents the frictional force generated at the primary transfer section in terms of torque on the drum shaft 9 of the photosensitive drum 100. The photosensitive drum 100 has load torque $T_L$ always generated thereon in a direction opposite to the rotational direction, by frictional forces generated by the blade of the cleaner 104, a bearing of the rotating shaft, etc. The load torque $T_L$ is therefore a value obtained by summing load torques caused by the blade of the cleaner 104, the drum bearing, etc. The friction torque $T_F$ is not included in the load torque $T_L$.

The above-mentioned load torque $T_L$ is much larger than a maximum value $T_{FMAX}$ of the friction torque $T_F$ ($T_L >> T_{FMAX}$), and hence the photosensitive drum 100 cannot be friction-driven by the intermediate transfer belt 108 using the friction torque $T_F$ alone.

Figure 6:
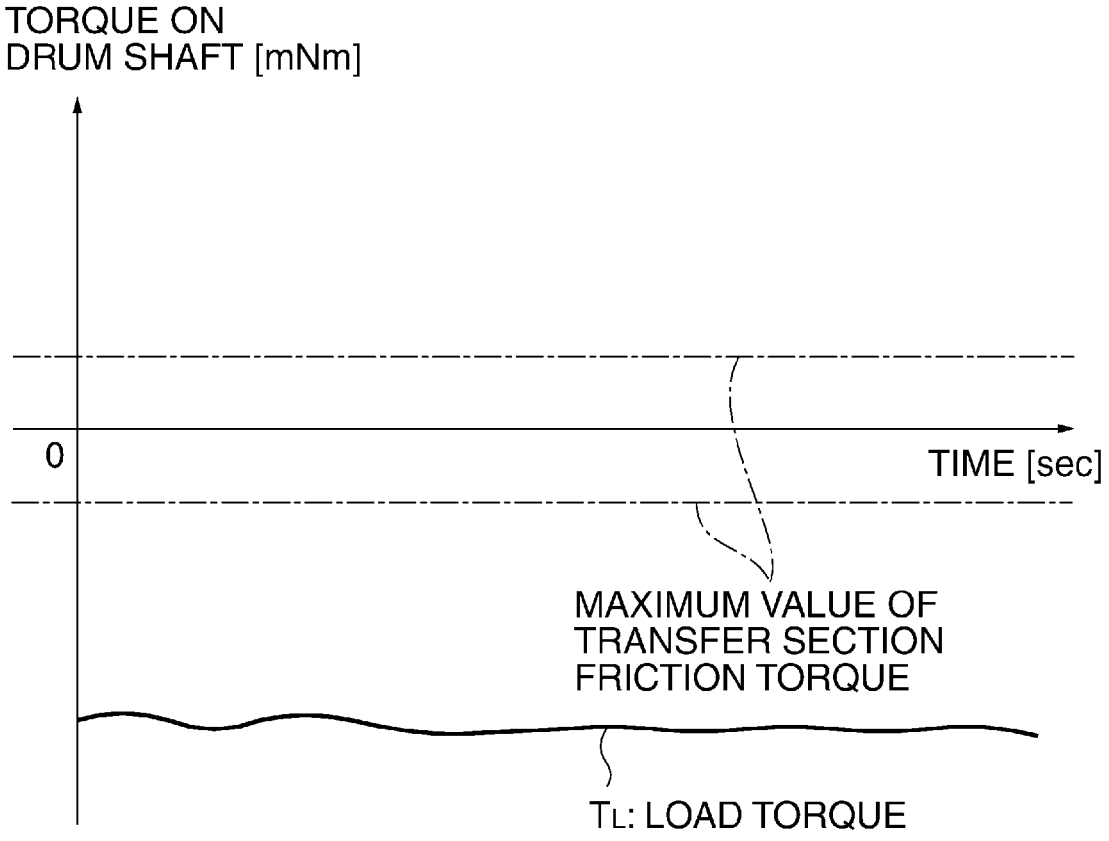
FIG. 6 is a diagram showing changes with time in load torque generated on a drum shaft of the photosensitive drum appearing in FIG. 5.

FIG. 6 is a diagram showing changes with time in load torque generated on the drum shaft 9 of the photosensitive drum 100 appearing in FIG. 5. The load torque $T_L$ is not always constant, but undergoes transient changes depending e.g. on a timing at which a high charge voltage is applied, and a timing at which remaining toner which has not been transferred meets the blade of the cleaner 104. Note that it is known that this transient change component (hereinafter referred to as the "varying torque component") is sufficiently small with respect to the load torque $T_L$ which is constantly generated.

To friction-drive the photosensitive drum 100 for rotation by the intermediate transfer belt 108, it is effective to eliminate the load torque $T_L$.

In the present embodiment, by applying the same amount of rotational torque as that of a DC-like component of the load torque $T_L$ to the photosensitive drum 100 in a direction opposite to the load torque $T_L$ using a rotational torque generation unit (e.g. the BLDC motor 5*a*), the load torque $T_L$ generated on the photosensitive drum 100 is offset. Thus applied rotational torque for offsetting the load torque ($T_L$) is referred to as assist torque.

Figure 7:
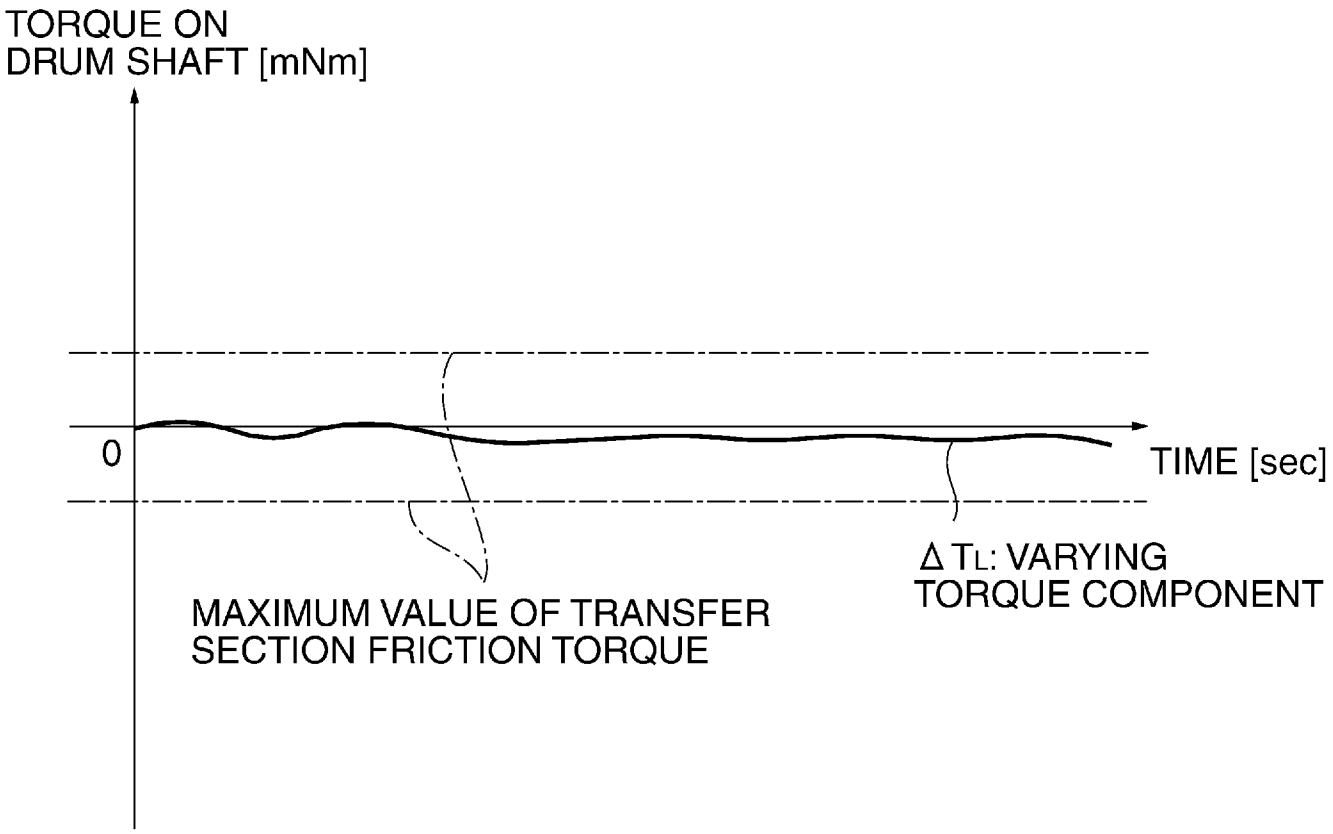
FIG. 7 is a diagram showing a state in which the load torque generated on the drum shaft appearing in FIG. 5 is offset by assist torque.

FIG. 7 is a diagram showing a state in which the load torque $T_L$ generated on the drum shaft 9 in FIG. 5 is offset by assist torque. In FIG. 7, a steady component of the load torque $T_L$ is offset by the assist torque applied to the photosensitive drum 100, and only varying torque component $\Delta T_L$ practically acts on the photosensitive drum 100.

By offsetting the steady component of the load torque $T_L$ by the assist torque $T_{AS}$, the varying torque component $\Delta T_L$, as a load torque component, becomes small compared with the friction torque $T_F$ which is applied to contact portions of the surface of the photosensitive drum 100 and the surface of the intermediate transfer belt 108. As a consequence, the photosensitive drum 100 is friction-driven in synchronism with changes in speed of the intermediate transfer belt 108. That is, if the varying torque component (component remaining after offsetting the load torque by the assist torque), which undergoes AC-like variation, is not larger than the maximum values of the transfer section friction torque $T_F$, the photosensitive drum 100 can be friction-driven by the intermediate transfer belt 108.

However, it is necessary to ensure followability of the photosensitive drum 100 for following up AC-like speed variation of the intermediate transfer belt 108, during rotation, and in the present embodiment, acceleration torque which is expressed by the product of the drum inertia and the angular acceleration of the drum shaft 9 of the photosensitive drum 100 is also taken into account.

That is, the friction driving in which the photosensitive drum 100 is friction-driven by the intermediate transfer belt 108 is realized on condition that the sum of the acceleration torque and the varying torque component on the photosensitive drum 100, and the friction torque $T_F$ generated between the photosensitive drum 100 and the intermediate transfer belt 108 always satisfy the following expressions of motion (1) and (2):

$$|T_F| \geq J \times d\omega/dt + T_L - T_{AS} \quad (1)$$

$$|T_F| \geq J \times d\omega/dt + \Delta T_L \quad (2)$$

wherein T: represents the maximum transfer section friction torque, J the equivalent moment of inertia on the drum shaft 9, $d\omega/dt$ the angular acceleration, $T_L$ the load torque, $T_{AS}$ the assist torque, and $\Delta T_L$ the varying torque component.

The expressions (1) and (2) indicate that the same amount of rotational torque as that of the DC-like component of the load torque $T_L$ is generated as the assist torque $T_{AS}$ in a direction opposite to the load torque to thereby reduce the amount of torque required to be applied to a range smaller than the maximum friction torque $T_F$.

The acceleration torque is expressed by multiplication of the equivalent moment of inertia of the drum shaft 9 (hereinafter referred to as the "equivalent moment of drum inertia") and the angular acceleration of the photosensitive drum 100. Note that the angular acceleration of each photosensitive drum 100 is a value determined based on a surface speed varying component of the intermediate transfer belt 108 detected at the primary transfer section. Further, the equivalent moment of drum inertia expresses all rotating loads as the inertia component of the drum shaft 9.

Figure 8:
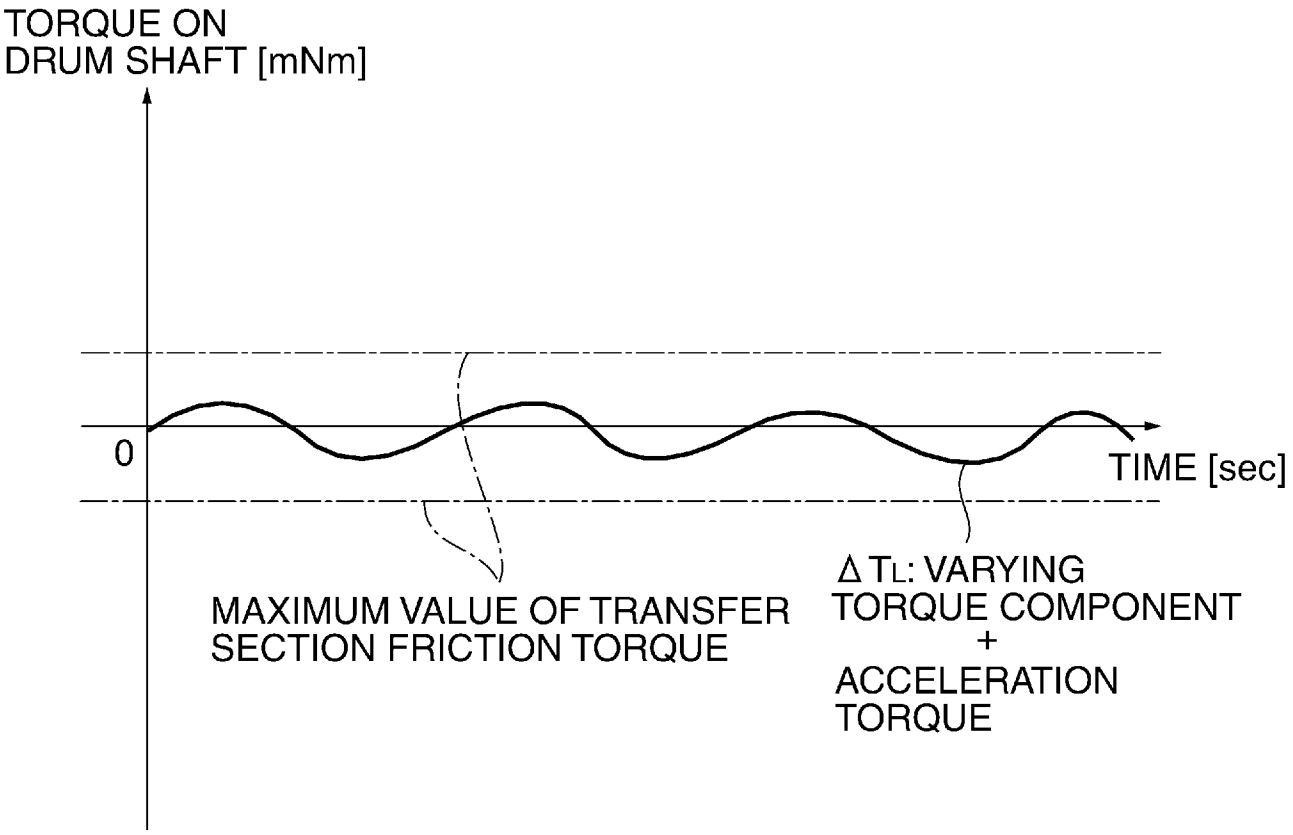
FIG. 8 is a diagram showing a relationship between changes with time in load torque as the sum of acceleration torque and a varying torque component, and maximum values of friction torque on the photosensitive drum appearing in FIG. 5.

FIG. 8 is a diagram showing a relationship between changes with time in load torque as the sum of acceleration torque and a varying torque component, and maximum values of friction torque on the photosensitive drum appearing in FIG. 5.

Referring to FIG. 8, the sum of the varying torque component $\Delta T_L$ and the acceleration torque is always smaller than the maximum value of the transfer section friction torque $T_F$.

Basically, the varying torque component $\Delta T_L$ can be regarded as a negligibly small one. Therefore, to increase the friction driving capability (followability) by torque other than the assist torque, it is envisaged to increase the maximum friction torque or reduce the acceleration torque. It is not easy to change the maximum friction torque because the maximum friction torque is closely associated with the toner transfer process in the primary transfer. On the other hand, reduction of the acceleration torque can be relatively easily realized by reducing the equivalent moment of drum inertia. An inertia component of the BLDC motor 5*a* added to the drum shaft 9 is largely influenced by a gear ratio between the reduction gear 10 and the motor shaft gear 11, and is represented by a value obtained by multiplying the motor shaft inertia by the square of the gear ratio. Therefore, the inertia of a rotor of the BLDC motor 5*a* sometimes becomes much larger than the inertia component of the photosensitive drum 100 acting on the drum shaft 9. To cope with this, the BLDC motor 5*a* in the present embodiment employs a low-inertia BLDC motor of an inner-rotor type. This makes it possible to largely reduce the equivalent moment of drum inertia, and as a result, the acceleration torque is also largely reduced.

By offsetting the DC-like component of the load torque on the drum shaft 9 by applying the assist torque and also by selecting the low-inertia motor, as described above, it is fully possible to cause the photosensitive drum 100 to be friction-driven by the intermediate transfer belt 108 using the friction torque $T_F$ at the transfer section. Although in the present embodiment, the BLDC motor 5*a* is used as a generation source of the assist torque, this is not limitative, but any other component may be employed insofar as it generates a constant torque.

Hereafter, a description will be given of a method of calculating the assist torque to be applied to the drum shaft 9 of the photosensitive drum 100 in order to cause the photosensitive drum 100 to be friction-driven by the intermediate transfer belt 108 in the image forming apparatus 200 shown in FIG. 1.

When the main power is turned on, first, the image forming apparatus 200 enters an adjustment mode. In the adjustment mode, adjustment of temperature of fixing rollers of the fixing device 114, correction of inclination of the main scanning line, inter-color correction, and so forth are performed. After completion of the adjustment mode, the image forming apparatus 200 shifts to a print mode in which a print operation can be performed.

A sequence for calculating the assist torque is executed in the adjustment mode. The image forming apparatus 200 is capable of performing processing at a plurality of process speeds e.g. so as to be compatible with not only plain paper but also thick paper. Therefore, the assist torque is required to be calculated on a process speed-by-process speed basis.

The assist torque is used for offsetting the load torque, and is calculated by measuring load generated on the drum shaft 9. In the present embodiment, load on the drum shaft 9 is calculated from a value of torque generated by the BLDC motor 5*a*.

As the motor driver IC 3*a* (see FIG. 2) for controlling the BLDC motor 5*a*, a driver IC is used which determines an amount of each phase current applied to the BLDC motor 5*a* based on the PWM signal. The PWM signal is a pulse width modulation signal which is a rectangular wave signal generated at a constant frequency, and the phase current is adjusted based on a duty factor determined according to a high-level duration of the PWM signal (obtained by dividing a high-level section by a PWM period). When the duty factor is large, the amount of electric current applied to each phase increases, whereas when the duty factor is small, the amount of electric current applied to the phase decreases. The magnitude of the phase current is equivalent to torque generated in the motor, and the magnitude of the phase current is proportional to the duty factor. Therefore, the duty factor can be considered as torque generated by the motor.

To calculate the assist torque, first, the primary transfer rollers 107 are separated from the intermediate transfer belt 108. Further, secondly, due to necessity of detecting the load torque on the drum shaft 9 generated during the image formation process, the process speed is controlled to a target process speed at which the image formation process is actually executed. Note that a varying torque component of load in the image formation process is sufficiently small compared with a constantly generated component of the load, and hence in calculating the assist torque, the image forming apparatus may be in an idling state.

In the assist torque calculation process executed during the adjustment mode, first, the host CPU 1 issues, to a driver IC (not shown) of a stepper motor for moving the primary transfer rollers up and down, an instruction for causing the primary transfer rollers 107 to retract, i.e. move down away from the associated photosensitive drums 100. Next, the host CPU 1 controls the various devices which execute the image formation process, such as the exposure devices 101, the primary electrostatic chargers 105, and the developing devices 102. Thirdly, the host CPU 1 issues an instruction for driving the photosensitive drums 100.

Figure 9:
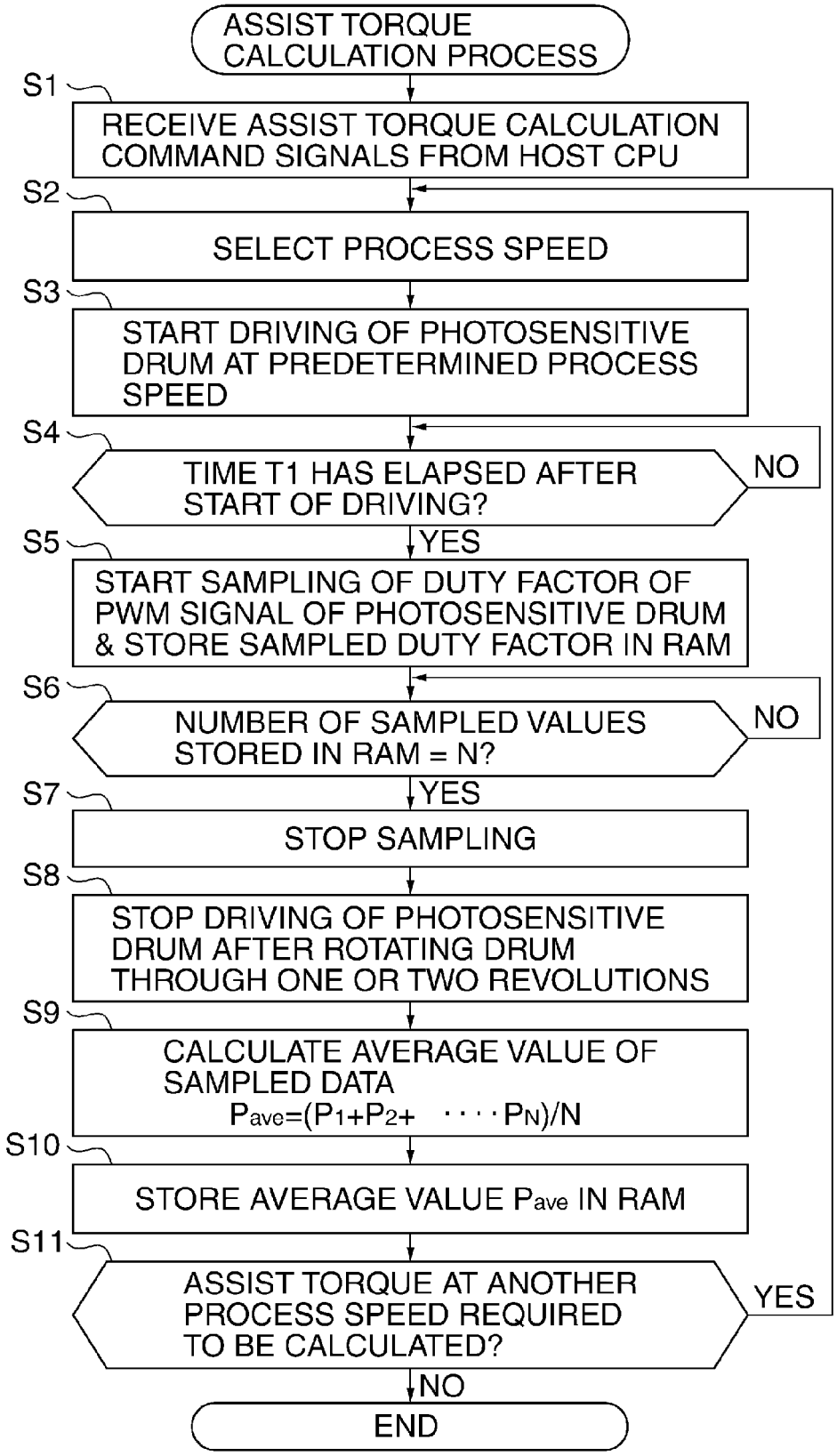
FIG. 9 is a flowchart of an assist torque calculation process performed by the image forming apparatus shown in FIG. 1.

FIG. 9 is a flowchart of the assist torque calculation process performed by the image forming apparatus shown in FIG. 1. The assist torque calculation process is executed by the CPU 13 having received an instruction from the host CPU 1 according to an assist torque calculation procedure implemented by an assist torque calculation program.

When the assist torque calculation process is started, first, the CPU 13 receives assist torque calculation command signals of a process speed setting value, an assist calculation-on command, etc. from the host CPU 1 (step S1). Then, the CPU 13 selects one of a plurality of process speeds for calculating assist torque according to a thickness of an associated recording sheet P, etc. (step S2).

After one of the process speeds is selected, the CPU 13 performs speed feedback control for controlling each photosensitive drum 100 to the selected process speed, and thereby starts driving of each photosensitive drum 100 (step S3).

When the driving of each photosensitive drum 100 is started, the CPU 13 waits until a predetermined time period (T1) elapses after driving of each photosensitive drum 100 is started (step S4). Then, after the predetermined time period elapses, the CPU 13 starts sampling of the duty factor of the PWM signal of the photosensitive drum 100, and stores the sampled value in the RAN 15 (step S5). Here, for example, an N-th sampled value is represented by $P_N$.

Then, the CPU 13 continues sampling of the duty factor until the number of sampled values becomes equal to a predetermined sample count N stored in the RAN 15 (step S6), and when the number of sampled values becomes equal to the predetermined sample count N, the CPU 13 stops sampling of the duty factor (step S7). Note that after sampling of the duty factor is terminated, the host CPU 1 stops the primary electrostatic chargers 105, the exposure devices 101, and the developing devices 102.

Then, the CPU 13 causes the photosensitive drums 100 to rotate through one or two revolutions, and stops driving of the photosensitive drums 100 by outputting a drive stop command (step S8). The photosensitive drums 100 are rotated through one or two revolutions so as to remove toner on the photosensitive drums 100 by the blades of the cleaners 104.

Next, the CPU 13 calculates an average value of the sampled duty factors P by the following equation (3) (step S9):

$$P_{ave} = \frac{P_1 + P_2 + P_3 + \ldots + P_N}{N} \tag{3}$$

wherein $P_{ave}$ represents the average value of the PWM duty factors, $P_N$ represents N-th sampled data, and N represents the sample count (the number of sampled values).

Then, the CPU 13 stores the average value $P_{ave}$ in the RAM 15 (step S10). This completes the calculation of the assist torque at one process speed.

Next, the CPU 13 determines whether or not the assist torque is required to be calculated at another process speed (step S11), and if the assist torque is required to be calculated (YES to the step S11), the steps S2 to S10 are repeated. On the other hand, if the assist torque is not required to be calculated at any other process speed (NO to the step S11), the CPU 13 terminates the present assist torque calculation process.

According to the process in FIG. 9, a plurality of duty factors P at a predetermined process speed are sampled, and an average value of these sampled values is calculated. As a result, it is possible to accurately calculate the duty factor P at the predetermined process speed, i.e. the assist torque $T_{AS}$ for offsetting the load torque $T_L$.

Although in the assist torque calculation process in FIG. 9, the assist torque is calculated in a state where the photosensitive drums 100 and the intermediate transfer belt 108 at the primary transfer sections are out of contact, this is not limitative, but the assist torque calculation process can be executed in a state different from the above-mentioned state insofar as the same amount of torque as that of the DC-like component of the load torque generated on the photosensitive drums 100 can be calculated.

Next, a description will be given of the exposure device 101 that exposes the surface of the associated photosensitive drum 100 to thereby form an electrostatic latent image on the surface of the photosensitive drum 100 of the image forming apparatus 200.

Figure 10:
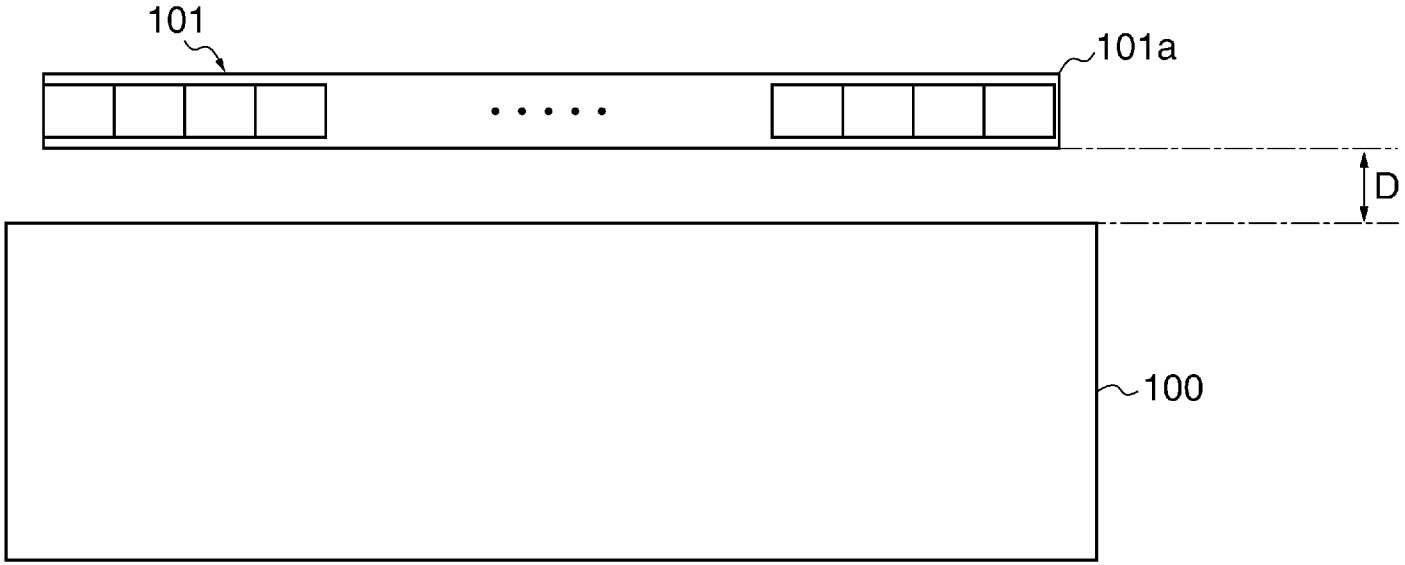
FIG. 10 is a diagram showing the arrangement of an exposure device of the image forming apparatus shown in FIG. 1.
Figure 11:
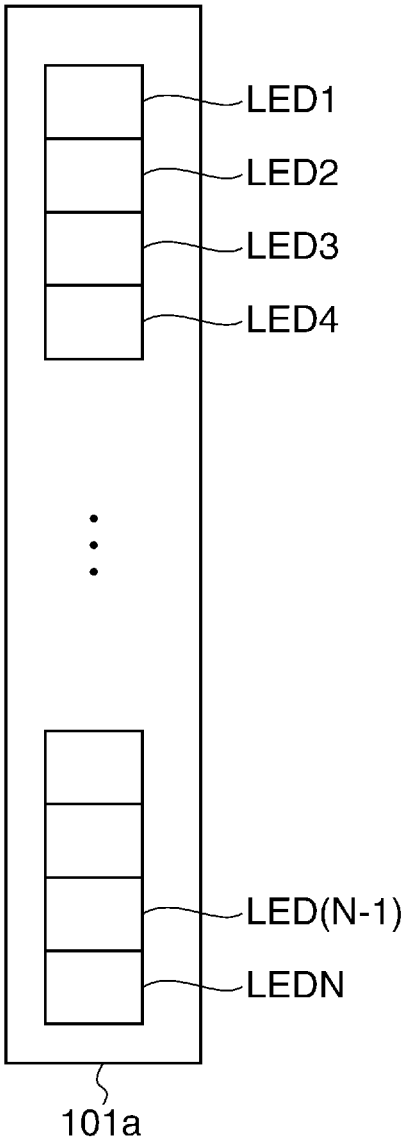
FIG. 11 is a schematic diagram of an LED head of the exposure device appearing in FIG. 10.

FIG. 10 is a diagram showing the arrangement of the exposure device 101 of the image forming apparatus 200 shown in FIG. 1. Referring to FIG. 10, an LED head 101*a* of the exposure device 101 is supported and fixed by a supporting member, not shown, at a location spaced from the photosensitive drum 100 by a predetermined distance D in a manner opposed to the photosensitive drum 100. As shown in FIG. 11, the LED head 10*a* is formed by arranging a plurality of small LED elements (LED1 to LEDN) in a main scanning direction, side by side.

Figure 12:
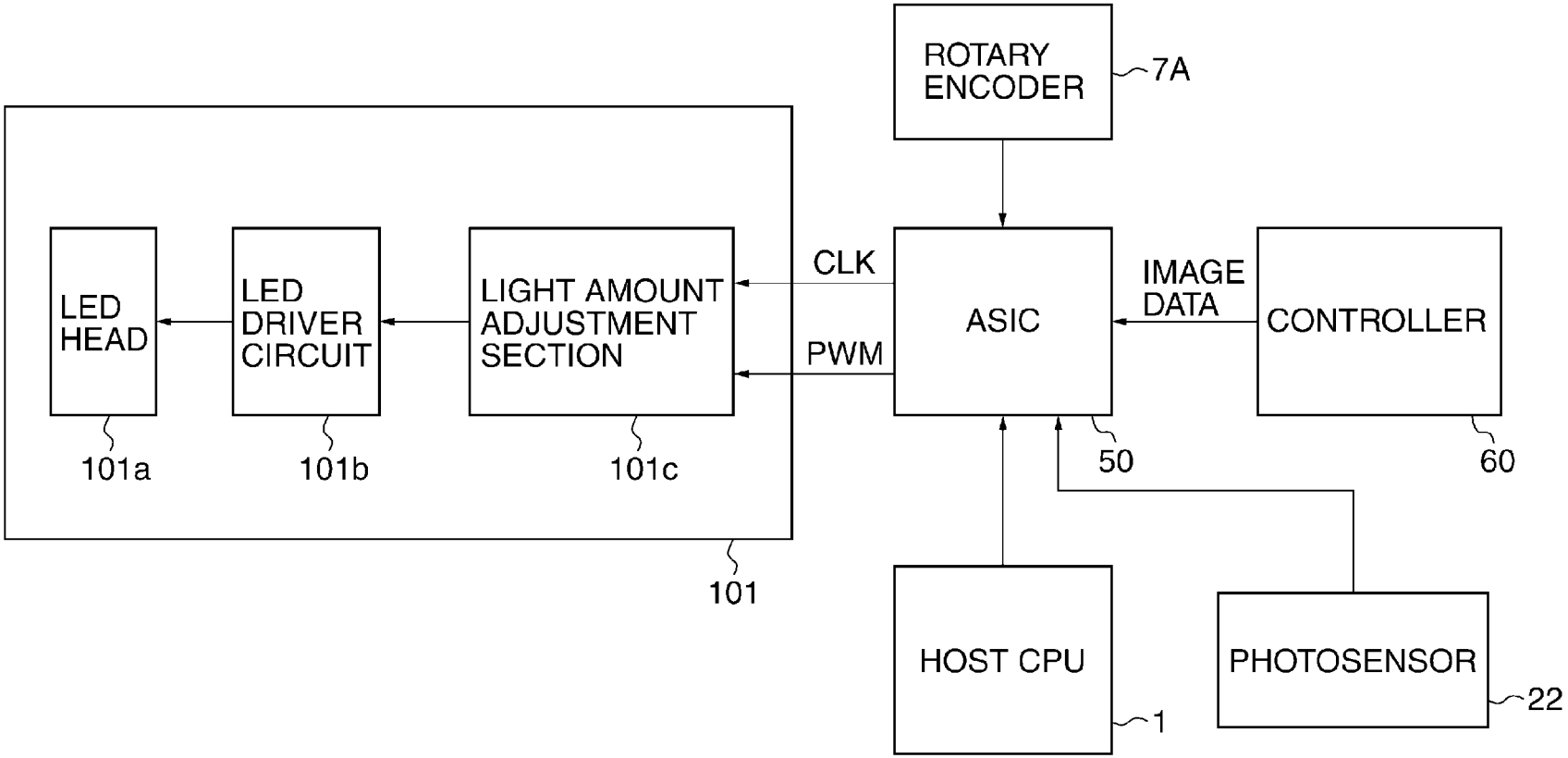
FIG. 12 is a block diagram showing the configuration for controlling the exposure device.
Figure 13:
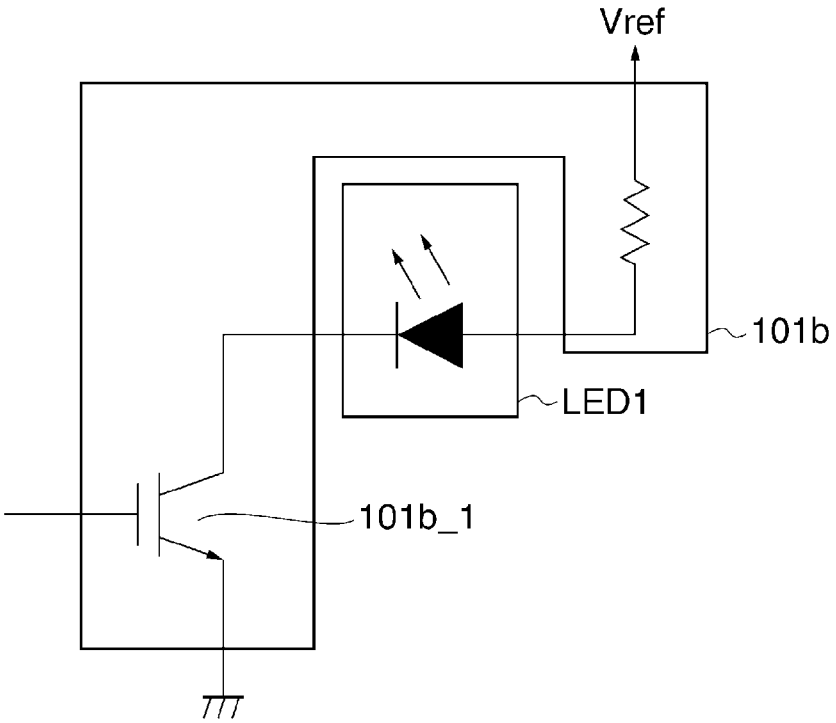
FIG. 13 is a diagram showing a connection state of each LED element of the LED head and an LED driver circuit appearing in FIG. 12.

FIG. 12 is a block diagram showing the configuration for controlling the exposure device 101, and FIG. 13 is a diagram showing a connection state of each LED element of the LED head 10*a* and an LED driver circuit 101*b* appearing in FIG. 12.

Referring to FIGS. 12 and 13, the exposure device 101 comprises the LED head 101*a*, the LED driver circuit 101*b* that drives the LED elements, and a light amount adjustment section 101*c*. The light amount adjustment section 101*c* is connected to an ASIC (application specific integrated circuit) 50, and the ASIC 50 is connected to the host CPU 1, the rotary encoder 7A, the photosensor 22, and a controller 60.

The following description is given of exposure control using the exposure device 101.

The exposure control is performed in synchronism with the rotation of the photosensitive drum 100 to thereby avoid positional displacement during exposure due to a surface speed variation of the photosensitive drum 100 caused in the case of time-synchronized exposure. The exposure control in the sub scanning direction for the exposure device 101 is performed in synchronism with a detection value detected by the rotary encoder 7A, described hereinafter.

The ASIC 50 (see FIG. 12) is configured to be capable of starting and stopping exposure, by receiving an LED exposure start timing signal, an LED exposure stop timing signal, and an exposure enable signal from the host CPU 1.

When exposing the surface of the photosensitive drum 100, the ASIC 50 divides the image data sent from the controller 60 into data of the respective colors of Y, M, C, and K. Further, the ASIC 50 calculates, based on the image data, an amount of light emission of each of LED elements arranged in the main scanning direction of the LED head 101*a* (the light emission amount is adjusted by a light emission time period, in the present embodiment). The ASIC 50 outputs emission time information associated with each LED element to the light amount adjustment section 101*c* as a CLK signal and a PWM signal. The light amount adjustment section 101*c* having received the signals sequentially selects respective bases of transistors 100*b*_1 (see FIG. 13) forming the LED driver circuit 101*b*, starting from one associated with the LED element LED1, according to the CLK signal. Then, an electrostatic latent image associated with the image data is formed in the main scanning direction by a PWM signal determining a high-level duration of base voltage of each selected LED base.

On the other hand, the exposure control in the sub scanning direction using the exposure device 101 is performed as follows:

The image forming apparatus 200 is configured to form image data of e.g. 600 dpi on a recording sheet, and the distance between lines in the sub scanning direction is a value obtained by dividing 2.54 cm by 600, i.e. approximately 42.3 μm (ΔL). The value ΔL is defined first as a target pitch distance of the line-to-line distance in the sub scanning direction. The rotational speed of the photosensitive drums 100 is calculated as a value obtained by converting the detection value from the rotary encoder 7A to the surface speed $V_s$, and a sub scanning exposure timing interval Δt is calculated by dividing ΔL by $V_s$. Then, the exposure is performed at the obtained sub scanning exposure timing interval Δt.

Next, a description will be given of off-centering of the drum shaft 9 which causes displacement of the exposure position when forming an electrostatic latent image by exposing the surface of the photosensitive drum 100.

Figure 14:
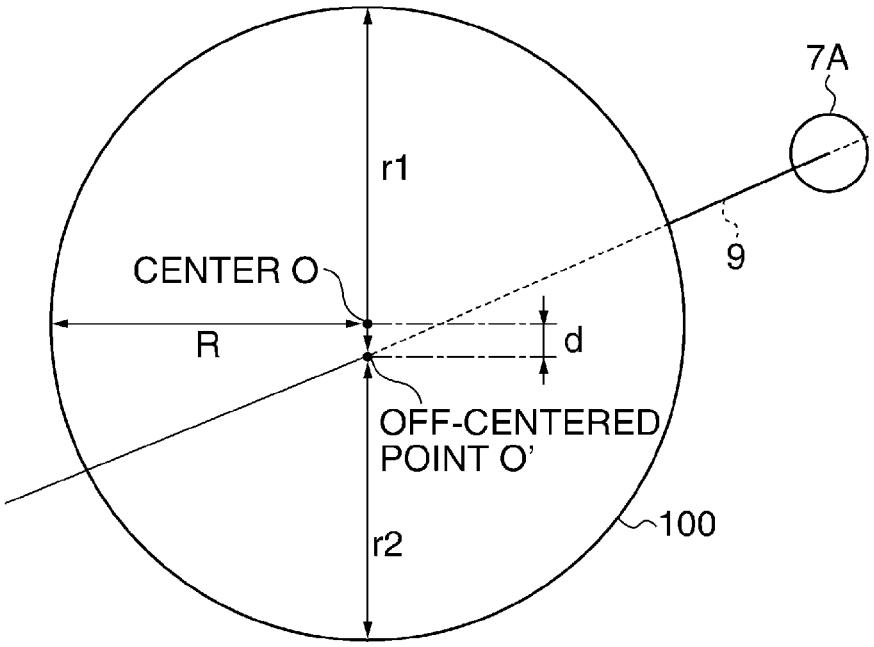
FIG. 14 is a cross-sectional view useful in explaining off-centering of the drum shaft of the photosensitive drum appearing in FIG. 2.

FIG. 14 is a diagram useful in explaining a state in which the drum shaft 9 of the photosensitive drum 100 appearing in FIG. 2 is off-centered.

Referring to FIG. 14, the drum shaft 9 is displaced from the center O of the photosensitive drum 100 by a distance d, and in this case, a detection value from the rotary encoder 7A which is disposed coaxially with the drum shaft 9 (and the reduction gear shaft 8) indicates a different value from the surface speed at the exposure position.

That is, in FIG. 14, assuming that the maximum radius and minimum radius of the photosensitive drum 100 generated by off-centering of the drum shaft 9 are r1 and r2, respectively, a speed difference of (r2−r1)ω1 is generated at the same angular speed ω1 between the maximum surface speed and the minimum surface speed. Therefore, in the synchronized exposure control (angular speed feedback control) using the rotary encoder 7A, displacement of the exposure position is caused by the off-center component of the drum shaft 9, during exposure.

To correct the displacement of the exposure position, in the present embodiment, correction of the exposure position is performed in the angular speed feedback control using the rotary encoder 7A. The exposure position is corrected by multiplying exposure data for exposing a surface area on the photosensitive drum 100 by the exposure device by a correction value calculated for each surface area on the photosensitive drum 100 (hereinafter referred to as the "correction coefficient").

The following description is given of calculation of the correction coefficient for correcting displacement of the exposure position.

Figure 15:
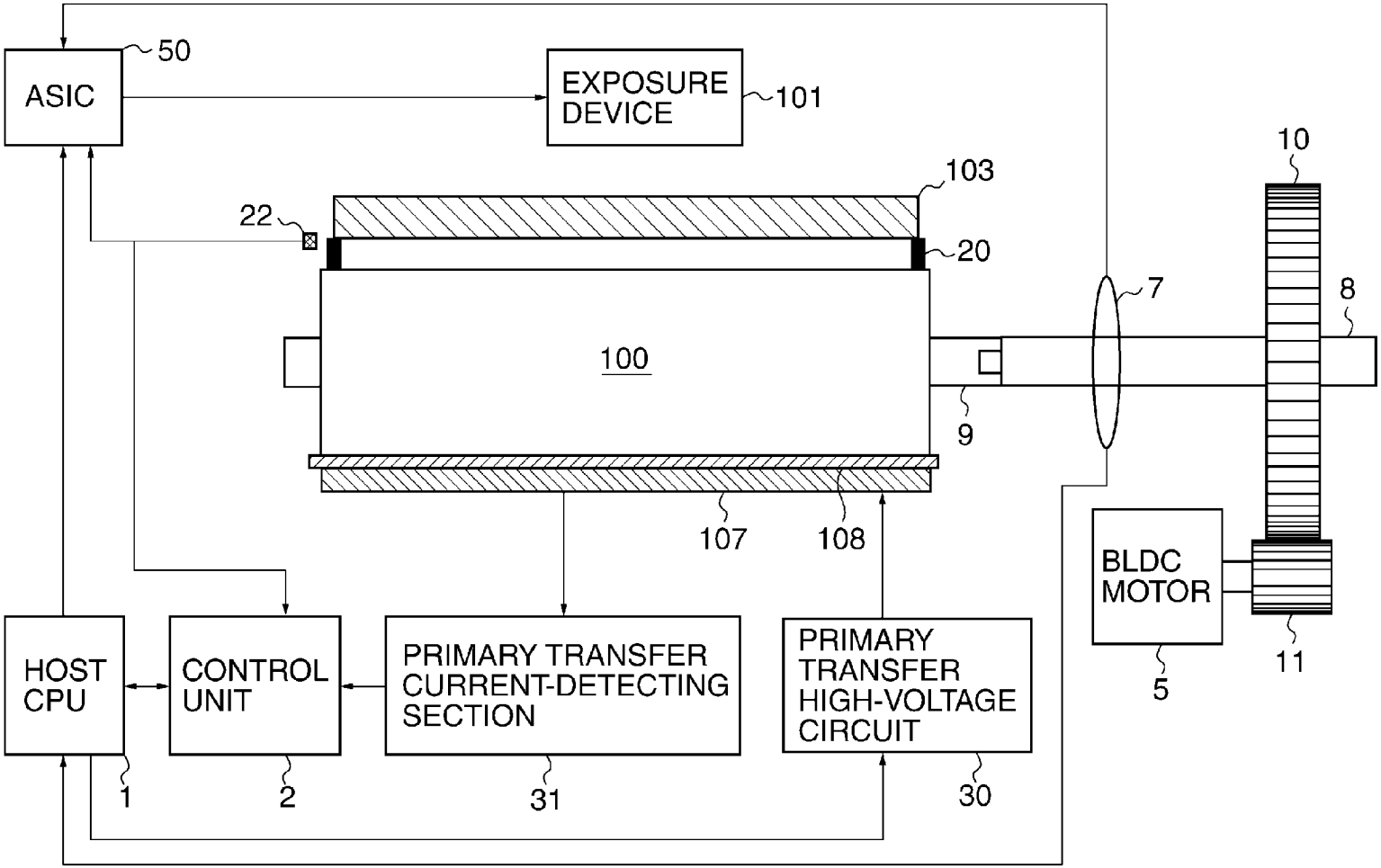
FIG. 15 is a diagram showing the system configuration for calculating an off-center component of the drum shaft appearing in FIG. 14.

FIG. 15 is a diagram showing the system configuration for calculating the off-center component of the drum shaft 9 appearing in FIG. 14.

Referring to FIG. 15, a system for calculating the off-center component of the drum shaft 9 includes, as hardware components, the photosensitive drum 100, and rotors 20 as rotating members which are provided between the photosensitive drum 100 and the developing sleeve 103 disposed in a manner opposed to the photosensitive drum 100. The rotors 20 have a function of maintaining the surface of the photosensitive drum 100 and the surface of the developing sleeve 103 in a state spaced from each other by a fixed distance, and are arranged one at each of opposite ends of the developing sleeve 103 in the main scanning direction. Each rotor 20 is formed e.g. by a bearing, and is in contact with a non-image forming area on the surface of the photosensitive drum 100 by a contact portion 21 which is an outer peripheral surface of the rotor 20 (see FIG. 16, described hereinafter). Further, the developing sleeve 103 have rotors 103*a* arranged on a rotating shaft of the developing sleeve 103, one at each of opposite ends thereof in the main scanning direction (see FIG. 16). Each rotor 103*a* is also formed e.g. by a bearing, similarly to the rotor 20.

Figure 16:
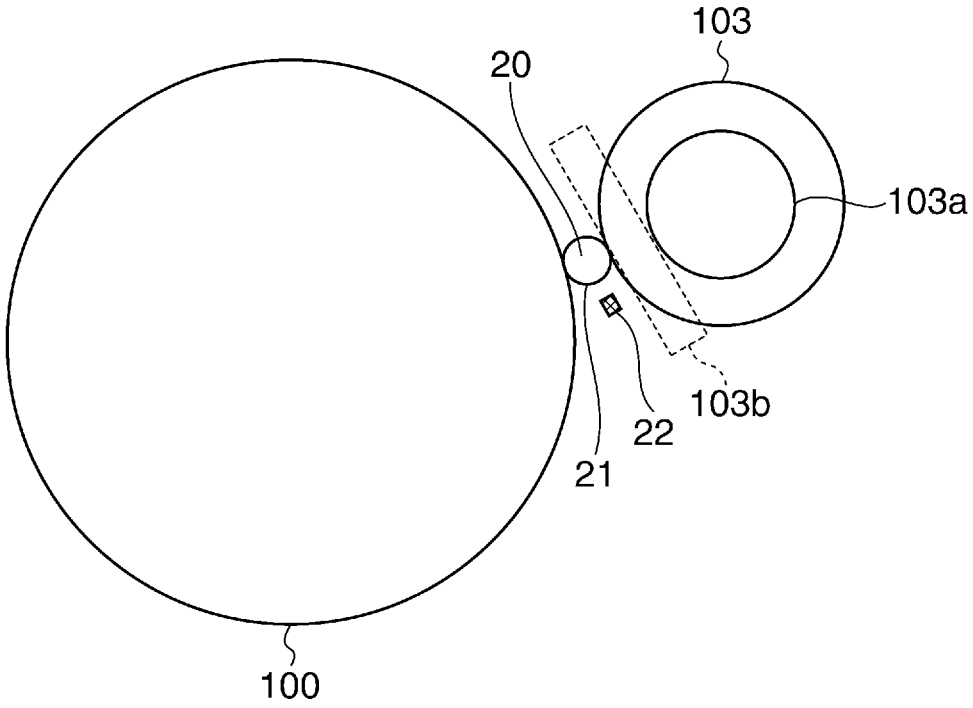
FIG. 16 is a diagram showing a cross section taken along a plane perpendicular to the direction of length of the drum shaft appearing in FIG. 15.
Figure 17:
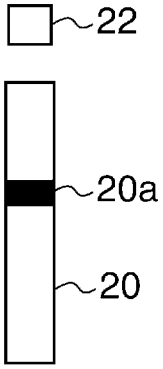
FIG. 17 is a side view showing an outer peripheral surface of a rotating member appearing in FIG. 16.

FIG. 16 is a diagram showing a cross section taken along a plane perpendicular to the direction of length of the drum shaft 9 appearing in FIG. 15.

Referring to FIG. 16, the rotor 20 is disposed between the photosensitive drum 100 and the developing sleeve 103, and the rotor 20 and the rotor 103*a* provided coaxially on the developing sleeve 103 are in abutment with each other via a spacer 103*b*. The distance between the surface of the developing sleeve 103 and the surface of the photosensitive drum 100 is properly maintained by the rotor 20, the rotor 103*a*, and the spacer 103*b* disposed between the rotors 20 and 103*a*. The rotor 20 is urged against the surface of the photosensitive drum 100 by a predetermined pressure. The urging pressure is defined by a mechanical device, not shown, such as a spring. When the photosensitive drum 100 rotates, the rotor 20 is friction-driven for rotation by the photosensitive drum 100. The photosensor 22 as a mechanical member is arranged in a manner opposed to the outer peripheral surface of the rotor 20. The photosensor 22 functions as a rotation detection unit.

The outer peripheral surface of the rotor 20 is formed with the marking 20*a* at a predetermined location, and for example, when the rotor 20 rotates through one revolution following the photosensitive drum 100, the marking 20*a* is detected by the photosensor 22. That is, the photosensor 22 detects the marking 20*a* whenever the rotor 20 rotates through one revolution to deliver the detection result to the ASIC 50.

As shown in FIG. 15, the drum shaft off-center component calculation system includes, as control components therefor, the host CPU 1, the controller 2, the ASIC 50, a primary transfer high-voltage circuit 30, and a primary transfer current-detecting section 31. The controller 2 also functions as a control unit that drives the photosensitive drum 100 (see FIG. 2). The primary transfer high-voltage circuit 30 is configured to cause the primary transfer roller 107 to generate predetermined high voltage at the primary transfer section, and is controlled by the host CPU 1. The primary transfer current-detecting section 31 is configured to detect electric current flowing from the primary transfer high-voltage circuit 30 to the photosensitive drum 100 via the primary transfer roller 107 (hereinafter referred to as the "primary transfer current"), and controls the high voltage such that the primary transfer current becomes equal to a predetermined current value. Note that the detection value detected by the primary transfer current-detecting section 31 is input to the controller 2.

Hereafter, a description will be given of a correction coefficient calculation process for correcting the amount of off-centering of the drum shaft using the drum shaft off-center component calculation system configured as above.

Figure 18:
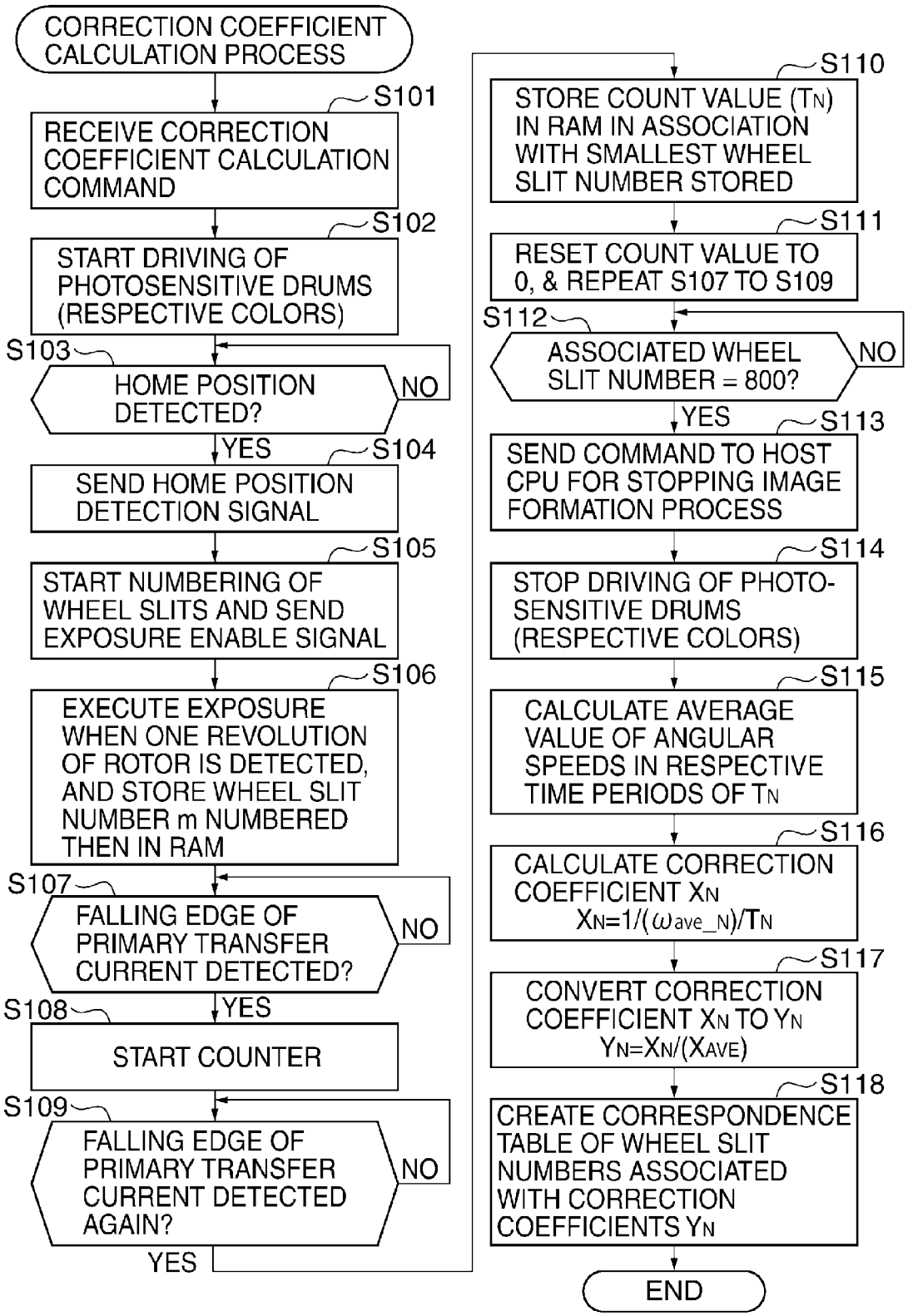
FIG. 18 is a flowchart of a correction coefficient calculation process performed by the image forming apparatus shown in FIG. 1, for calculating a correction coefficient for correcting the off-center component of the drum shaft of the photosensitive drum.

FIG. 18 is a flowchart of a correction coefficient calculation process performed by the image forming apparatus 200 shown in FIG. 1, for correcting the amount of off-centering of the drum shaft of the photosensitive drum 100.

This correction coefficient calculation process is executed during the adjustment mode of the image forming apparatus 200, and the CPU 13 of the controller 2 (see FIG. 4) having received a correction coefficient calculation command from the host CPU 1 executes the process according to a correction coefficient calculation process program.

That is, upon receipt of the correction coefficient calculation command from the host CPU 1 (step S101), the CPU 13 starts the correction coefficient calculation process for correcting the amount of off-centering of the drum shaft and starts driving of each photosensitive drum 100 (step S102). At this time, the photosensitive drum 100 is driven according to a driving method using a predetermined assist torque calculated by the above-described assist torque calculation process described hereinabove with reference to FIG. 9.

After driving of the photosensitive drum 100 is started, the CPU 13 waits for a photosensor 7*d* (see FIG. 19, referred to hereinafter) of the rotary encoder 7A to detect a home position (slit 7*f*) which is a reference position of rotation of the photosensitive drum 100 (step S103).

Figure 19:
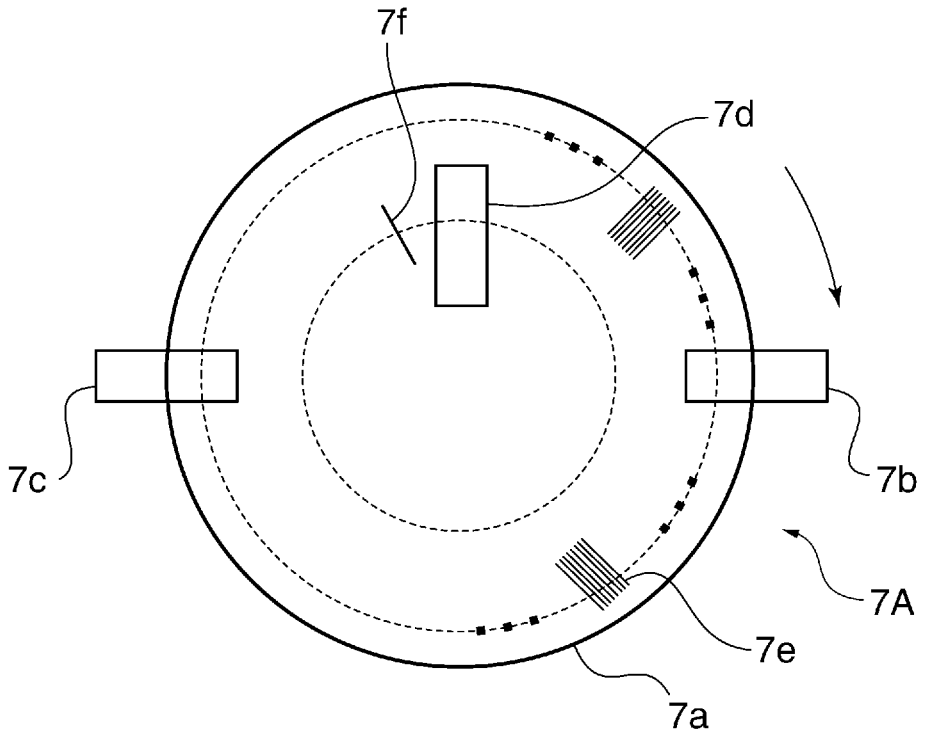
FIG. 19 is a schematic diagram of a rotary encoder appearing in FIG. 2.

FIG. 19 is a schematic diagram of the rotary encoder 7A appearing in FIG. 2.

Referring to FIG. 19, the rotary encoder 7A mainly comprises a wheel 7*a*, and photosensors 7*b*, 7*c* and the photosensor 7*d*, which are provided in a manner opposed to respective parts of a circular plane of the wheel 7*a*. The wheel 7*a* is fixedly fitted on the reduction gear shaft 8 of the photosensitive drum 100, and the photosensors 7*b*, 7*c*, and 7*d* are fixed to a supporting member, not shown. The wheel 7*a* is formed with wheel slits 7*e* at equally-spaced intervals in a circumferential direction of the circular plane, and the wheel slits 7*e* are detected by the photosensors 7*b* and 7*c*. The wheel slits 7*e* are formed along the whole circumference of the wheel 7*a*, and the number of the wheel slits 7*e* is set to e.g. 800. However, this number is an arbitrary one, and is not limitative. Note that when detecting the surface speed of the photosensitive drum 100 so as to calculate the correction coefficient, the controller 2 applies an average value of respective detection values from the photosensors 7*b* and 7*c* to the calculation process.

Further, the circular plane of the wheel 7*a* has the slit 7*f* formed through an inner peripheral portion inward of the wheel slits 7*e* at only one point in the circumferential direction, and the slit 7*f* is detected by the photosensor 7*d*. The slit 7*f* is referred to as the home position, and is set as a reference position of rotation of the photosensitive drum 100.

A description will be given of a calculation process for calculating the surface speed $V_s$ of the photosensitive drum 100 based on the detection values detected by the photosensors 7*b* and 7*c* of the rotary encoder 7A shown in FIG. 19.

Figure 20:
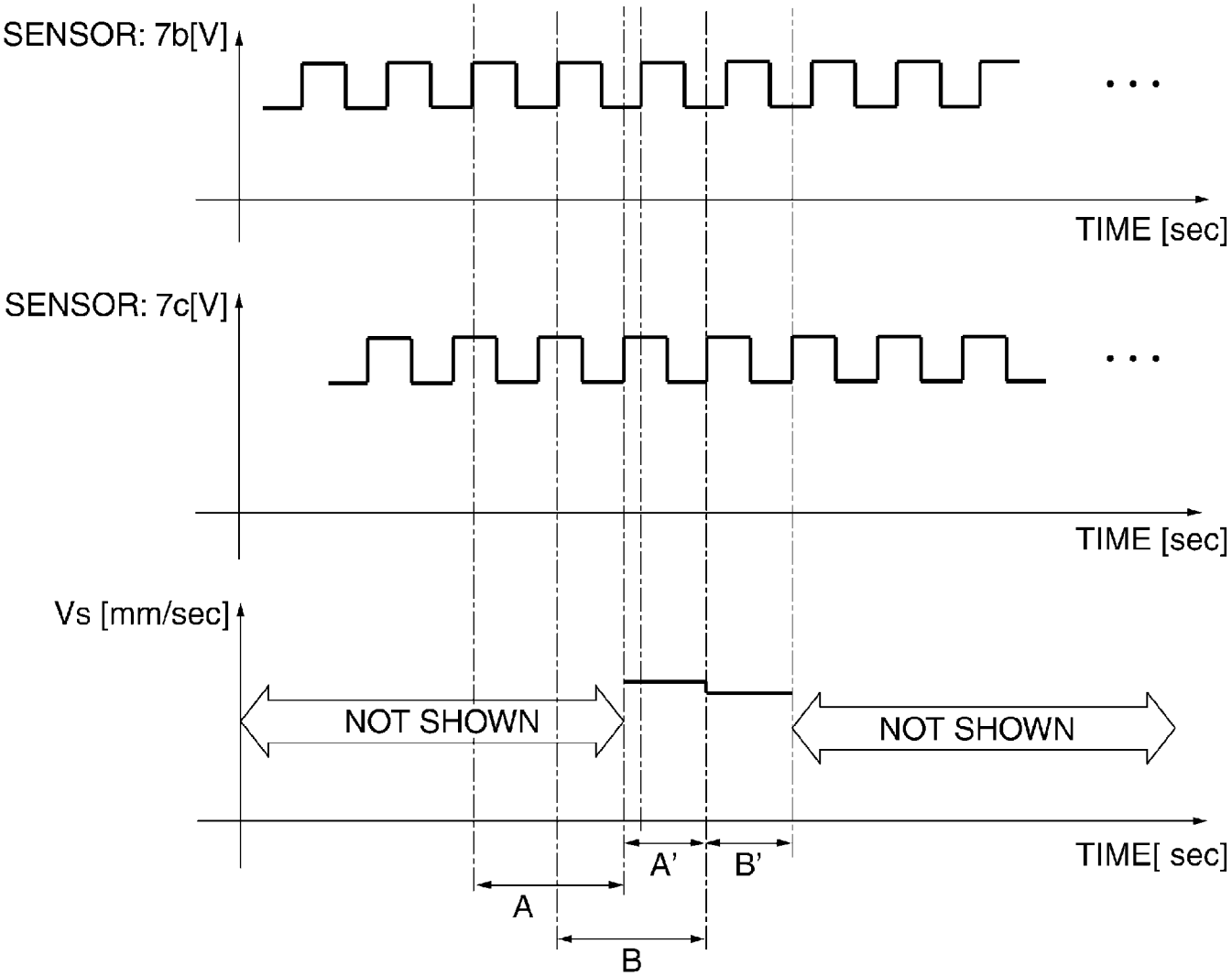
FIG. 20 is a diagram useful in explaining a calculation process for calculating a surface speed of the photosensitive drum based on detection values from the rotary encoder shown in FIG. 19.

FIG. 20 is a diagram useful in explaining the calculation process for calculating the surface speed $V_s$ of the photosensitive drum 100 based on detection values output from the rotary encoder 7A.

When the photosensitive drum 100 starts to rotate, square-wave pulses are generated by the photosensors 7*b* and 7*c* detecting the wheel slits 7*e*. A signal output from each of the photosensors 7*b* and 7*c* when detecting a wheel slit 7 opposed to each of them is at a high level, whereas when detecting no wheel slit 7*e*, the signal output from the same is at a low level. The high-level signal and low-level signal are output from each of the photosensors 7*b* and 7*c* to the controller 2. The controller 2 detects rising edges at which the signal level of each of the detection signals from the photosensors 7*b* and 7*c* is changed from low to high, and further calculates a time period $T_{ENC}$ between adjacent ones of the rising edges by counting a time interval between them. At a timing at which values of the time period $T_{ENC}$ are determined based on the respective signals from the two photosensors 7*b* and 7*c*, an average value $T_{ENCAVE}$ of the values of the time period $T_{ENC}$ is calculated.

Sections A and B in FIG. 20 are speed detection sections, and to detect the surface speed of the photosensitive drum 100, the controller 2 calculates the time period $T_{ENCAVE}$ corresponding to each of the sections A' and B' by dividing each of respective time periods corresponding to the sections A and B by 2, each of which is defined as a section from a rising edge of the signal output from the photosensor 7*b* to a second rising edge of the signal output from the photosensor 7*c* occurring thereafter. The controller 2 thus calculates the average value of the detection values (detected time periods) for each section in which a rising edge of the signal output from the photosensor 7*b* is detected earlier. The surface speed $V_s$ is calculated from the detection value (average value) $T_{ENCAVE}$ thus calculated, the radius of the photosensitive drum 100 (design value), and the angle of the pitch distance of the wheel slits 7*e* (obtained by 360°÷800=0.45°=81÷π in the present embodiment).

That is, the surface speed ($V_S$) of the photosensitive drum 100 is calculated by the following equation:

$$V_s = \frac{R \times 81 \div \pi}{T_{ENCAVE}} \tag{4}$$

wherein r represents the radius of the photosensitive drum (design value), and $T_{ENCAVE}$ represents the detection value (time period) from the rotary encoder 7A.

From the above, by dividing the line-to-line distance ΔL in the sub scanning direction by the calculated surface speed ($V_s$) of the photosensitive drum 100 calculated as above, it is possible to define the sub scanning exposure timing interval.

However, as is clear from the equation (4), since the surface speed is calculated assuming that the radius r is constant, if the rotational axis of the drum shaft 9 is off-centered from the center position of the photosensitive drum 100, the surface speed at the exposure position is different from the one calculated by the equation (4). Therefore, in the present embodiment, the correction coefficient is calculated for each predetermined area on the surface of the photosensitive drum 100, and an electrostatic latent image without positional displacement is formed on the surface of each photosensitive drum 100 at the sub scanning exposure timing interval (exposure data) based on the actual surface speed which has been corrected by the calculated correction coefficient (see FIG. 24, described hereinafter).

Referring again to FIG. 18, when the CPU 13 confirms that the photosensor 7*d* of the rotary encoder 7A has detected the slit 7*f*, the CPU 13 transmits a home position detection signal to the host CPU 1 (step S104). At this time, the host CPU 1 having received the home position detection signal from the CPU 13 outputs the exposure enable signal to the ASIC 50.

Next, the CPU 13 having sent the home position detection signal to the host CPU1 starts numbering of each wheel slit 7*e* according to detection of the wheel slit 7*e* by the photosensor 7*b* of the rotary encoder 7A (step S105). Here, the wheel slits 7*e* are sequentially numbered starting from No. 1, and are numbered finally up to e.g. No. 800 which is the total number of the wheel slits, as described with reference to FIG. 19. Note that at this time, the ASIC 50 having received the exposure enable signal sends a command for starting exposure to the exposure device 101. Note that as mentioned hereinafter, exposure by the exposure device 101 is executed at a timing at which the marking 20*a* of the rotor 20 is detected by the photosensor 22 (see FIG. 16) arranged between the photosensitive drum 100 and the developing sleeve 103.

The image data sent to the exposure device 101 is a zebra pattern stored in the ASIC 50 in advance, and whole solid image formation data having a predetermined density or non-image formation data is sent in synchronism with detection of the marking 20*a* by the photosensor 22. A latent image pattern composed of solid image portions and non-image portions is formed based on the sent data, and the formed latent image pattern is developed to thereby form a developed pattern composed of the solid image portions and the non-image portions. The manner of sending image data is configured in advance such that in response to first detection of the mark pattern by the photosensor 22, the whole solid image formation data is sent.

Figure 21:
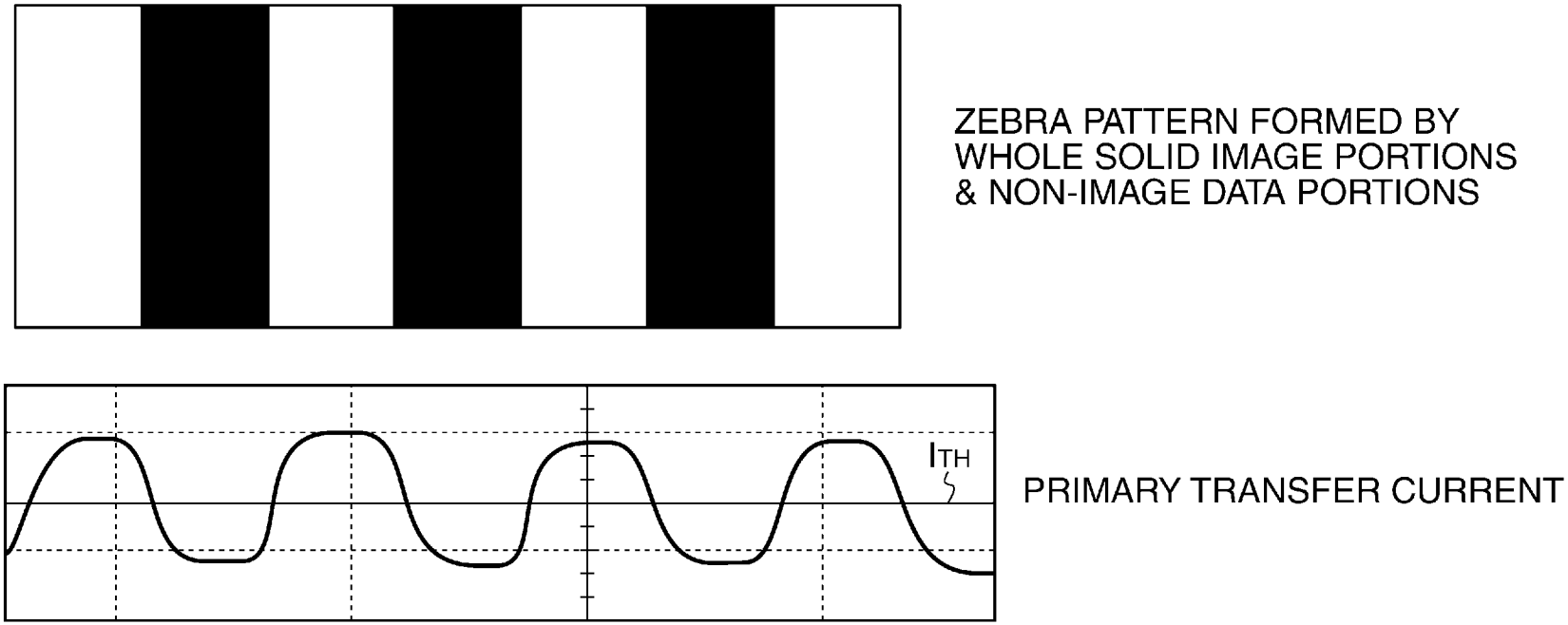
FIG. 21 is a diagram showing image data (zebra pattern data) formed such that a toner-present portion and a toner-absent portion alternately pass a primary transfer section, and a detected waveform of primary transfer current detected by a primary transfer current-detecting section.

FIG. 21 is a diagram showing image data (zebra pattern data) formed such that a toner-present portion and a toner-absent portion alternately pass the primary transfer section, and a detected waveform of primary transfer current detected according to the image data by the primary transfer current-detecting section 31, in association with each other. Referring to FIG. 21, the primary transfer current associated with the solid image portion is small, and the primary transfer current associated with the non-image portion is large. The present embodiment uses the characteristic of the primary transfer current value which changes between the case where toner exists at the primary transfer section and the case where toner does not exist at the primary transfer section.

In FIG. 21 which shows the detected waveform of the primary transfer current, by setting a predetermined current value as a threshold value $I_{TH}$, and thereby converting the primary transfer current value to a square-wave pulse signal, it is possible to measure respective time periods of each toner-present section and each toner-absent section. Note that the rise time and fall time of the pulse signal of the primary transfer current value can be changed by changing a filter constant determined by a resistor R and a capacitor C forming the primary transfer current-detecting section.

At this time, the toner-present section and the toner-absent section in the zebra pattern formed on the surface of the photosensitive drum 100 are always formed at equally-spaced intervals. By measuring duration (detected time period) of each pulse of the pulse signal indicative of the primary transfer current value output according to the zebra pattern, and the angular speed of each surface area on the photosensitive drum 100, which is associated with the duration (detected time period), it is possible to determine the radius r from the center of rotation of the drum shaft 9 to the primary transfer section (given position on the surface of the photosensitive drum 100) by the following equation (5):

$$L = \omega \times r \times t \tag{5}$$

$$r = \frac{L}{\omega \times t}$$

wherein t: time period detected based on the primary transfer current (detected time period)

ω: angular speed of the drum shaft 9 detected by the rotary encoder 7A

L: space interval of the zebra pattern (always uniformly formed on the photosensitive drum)

Therefore, by thus measuring the radius r at each area position on the surface of the photosensitive drum 100, it is possible to obtain changes in the radius r from the center of rotation of the drum shaft 9 to the surface of the photosensitive drum 100. In the above equation (5), L corresponds to a perimeter of a sector as a portion of the rotor 20, and a value itself of the perimeter has no meaning, and hence in actuality, a ratio of change of the radius r is detected by setting L=1, whereby the off-center component of the drum shaft 9 is calculated.

Referring again to FIG. 18, next, whenever the CPU 13 detects a detection signal indicative of detection of one revolution of the rotor 20, from the photosensor 22, the CPU 13 stores a wheel slit number m given to a wheel slit 7*e* immediately before the detection, at the timing of detection of the detection signal, in the RAM 15, and causes the exposure device 101 to execute exposure of a zebra pattern (step S106). Next, the CPU 13 determines whether or not a value output from the primary transfer current-detecting section has become smaller than $I_{TH}$, i.e. whether or not the primary transfer current falls, and, if not, waits for the primary transfer current to fall (step S107). Note that the solid image portion of the zebra pattern is detected by falling of the primary transfer current.

In the step S107, if the falling edge of the primary transfer current is detected, the CPU 13 starts a counter for calculating a falling edge-to-falling edge section of the primary transfer current, and starts counting elapsed time (step S108).

Then, the CPU 13 determines whether or not the falling edge of the primary transfer current is detected again, and, if not, waits for the falling edge of the primary transfer current to be detected again (step S109). After the falling edge of the primary transfer current is detected again, the CPU 13 stores a cumulative count value $T_N$ (N: an integer) counted by the counter in the RAM 15, in association with the smallest one of the wheel slit numbers m sequentially stored in the RAM 15 in the step S106, and then deletes the smallest number (step S110). After storing the cumulative count value $T_N$ counted by the counter, the CPU 13 resets the count of the counter to 0, and then repeats the steps S7 to S9 until the wheel slit number m associated with the cumulative count value $T_N$ becomes equal to 800 (step S111). The primary transfer current-detecting section functions as a pitch detection unit.

Then, the CPU 13 determines whether or the wheel slit number m associated with the cumulative count value $T_N$ is equal to 800 (step S112), and if it is equal to 800, the CPU 13 sends a command to the host CPU 1 for stopping the image formation process (step S113). Upon receipt of this command from the CPU 13, the host CPU 1 sequentially stops the high-voltage power supply and the exposure control. Then, the CPU 13 stops driving of the photosensitive drums 100

(step S114). Next, the CPU 13 calculates the average value of the angular speeds ωn (n is an integer) in the respective time periods each associated with the pattern (zebra pitch) number $T_N$ (N is an integer) formed by the toner image (step S115).

Then, the CPU 13 calculates the correction coefficient $X_N$ (N is an integer) of the radius r in each image formation area on the surface of the photosensitive drum 100 based on off-centering of the drum shaft 9 of the photosensitive drum 100, by the following equation (6) (step S116):

$$X_N=1/(\omega_{ave_}N)/T_N \quad (6)$$

Then, the CPU 13 converts the correction coefficient $X_N$ to $Y_N$ by the following equation (7) (step S117):

$$Y_N=X_N/(X_{AVE}) \quad (7)$$

wherein $X_{AVE}$ represents the average value of $X_N$.

Then, the CPU 13 creates a wheel slit number table associated with the correction coefficient $Y_N$ (step S18).

According to the correction coefficient calculation process in FIG. 18, the zebra pattern is formed on the surface of the photosensitive drum 100 according to detection of the marking 20*a* of the rotor 20 which is friction-driven along with rotation of the photosensitive drum 100. Then, a radius r of the photosensitive drum 100 for each zebra pattern is determined based on a detection time period during which a formed zebra pattern is detected, an angular speed ω of the drum shaft 9 in the detection time period, and the pitch of the zebra pattern (zebra pitch). This operation is performed for the whole circumference of the wheel 7*a*, i.e. the whole circumference of the photosensitive drum 100. Then, a correction coefficient $X_N$ for the drum radius r which is varied by off-centering of the drum shaft 9 is calculated based on the average value of the angular speed ω associated with each zebra pitch, and the zebra pitch. Further, the calculated correction coefficient $X_N$ for each zebra pitch is divided by the average value of the correction coefficient $X_N$ to thereby obtain the correction coefficient $Y_N$ as the correction coefficient ratio for each zebra pitch. Then, the correspondence table is created by associating the obtained correction coefficient $Y_N$ with each wheel slit number. This makes it possible to determine the correction coefficient for correcting positional displacement during exposure caused by off-centering of the drum shaft 9 in a manner associated with the address location on the surface of the photosensitive drum 100.

The created correspondence table is shown in FIG. 22.

FIG. 22 is the correspondence table indicating the address locations on the surface of the photosensitive drum 100 and the correction coefficients $Y_N$, which are associated with the address locations, respectively. Note that when it is determined in the step S112 in FIG. 18 that the wheel slit number m is equal to 800, the marking detection signal from the rotor 20 is not synchronized, and hence the detection result of the immediately preceding zebra pattern is used for the address of the corresponding section.

Here, the offset (200+α) in FIG. 22 will be described.

In the image forming apparatus according to the present embodiment, each exposure device 101 is arranged at a location opposite from the primary transfer section (location rotated from the primary transfer section through 180°). Further, the photosensor 7*b* is disposed at a location displaced from the location of the exposure device 101 further by 90° forward in the rotational direction of the photosensitive drum 100. The circumference of the wheel 7*a* corresponds to 800 slits, and hence the slit 7*f* as the exposure position is displaced from the slit 7*f* at the photosensor 7*b* by a distance corresponding to 200 slits.

Figure 23:
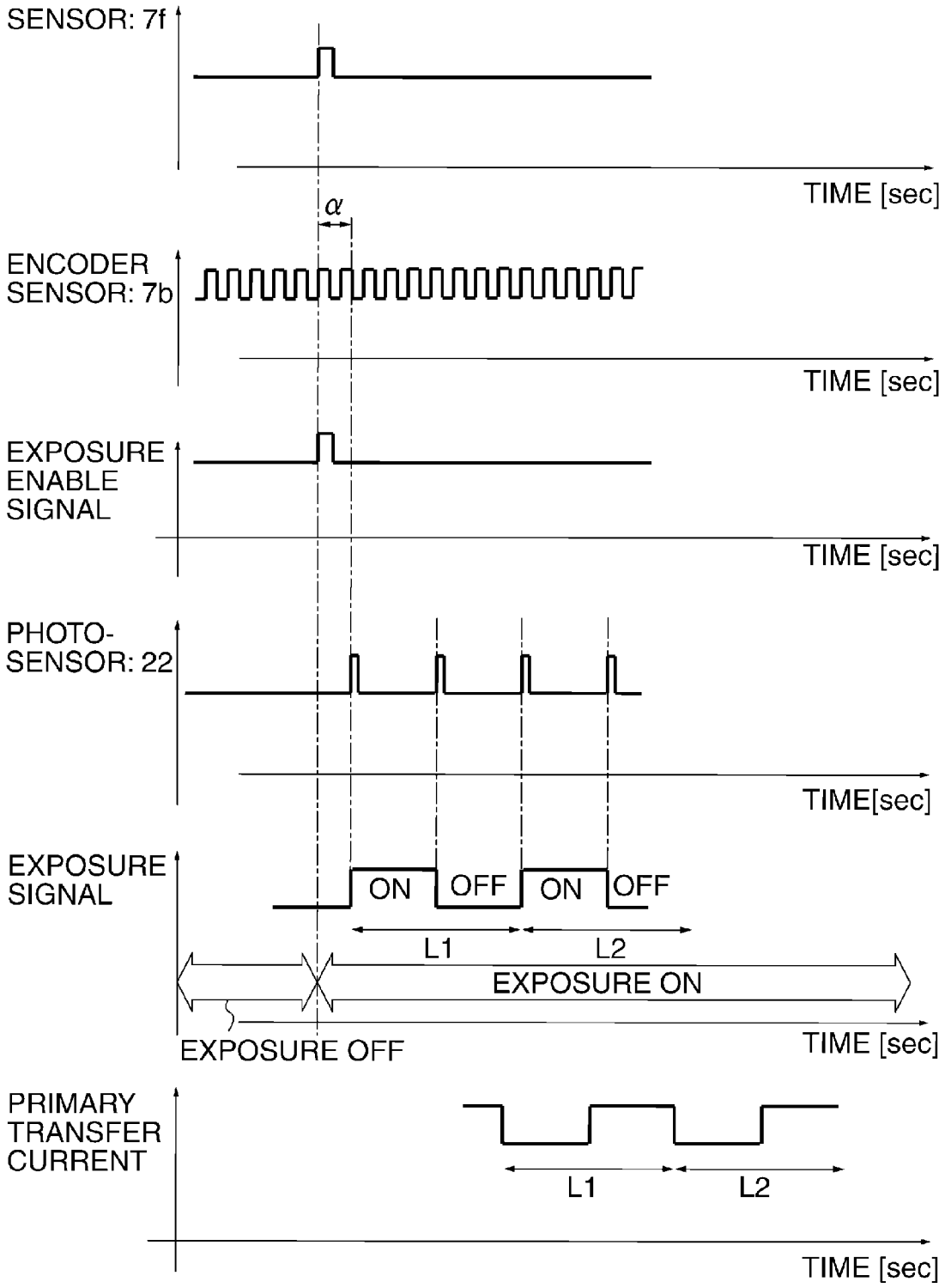
FIG. 23 is a timing diagram of various signals used in detecting an amount of off-centering of the drum shaft.

FIG. 23 is a timing diagram of various signals used in detecting an amount of off-centering of the drum shaft.

FIG. 23 shows main signals applied to a drum shaft off-center component calculation process. First, the photosensor 7*b* detects the home position (slit 7*f*). When the home position is detected, numbering of the wheel slits 7*e* is started which is performed in response to detection of each rising edge of the pulse signal output from the photosensor 7*b*. At the same time, an exposure enable signal is output from the host CPU 1 to the ASIC 50, and the ASIC 50 starts the exposure control. After that, the ASIC 50 starts to output the zebra pattern (see FIG. 21) in synchronism with detection of the marking by the photosensor 22. When toner transferred onto the surface of the photosensitive drum 100 by the developing device 102 reaches the primary transfer section, the detection value of the primary transfer current changes (see FIG. 21). Therefore, by setting the predetermined threshold value, a time period of duration of detection of the zebra pattern can be measured with reference to the falling edge. The symbol α in FIG. 23 indicates the number of wheel slits 7*e* detected by the photosensor 7*b* after detection of the home position and until detection by the ASIC 50 of the detection signal sent from the photosensor 22 thereto which is indicative of one revolution of the rotor 20.

That is, when forming an electrostatic latent image by exposing the photosensitive drum 100, by applying a correction coefficient associated with an address location which is calculated by adding "200+α" to an address location on the surface of the photosensitive drum 100 which becomes opposed to and is detected by the photosensor 7*b*, it is possible to correct the amount of off-centering of the drum shaft 9 in the actual exposure area. This makes it possible to form the accurate electrostatic latent image without positional displacement.

Hereafter, a description will be given of a print process (sub scanning exposure process) in which the correction coefficient for correcting a calculated amount of off-centering of the drum shaft is taken into account.

Figure 24:
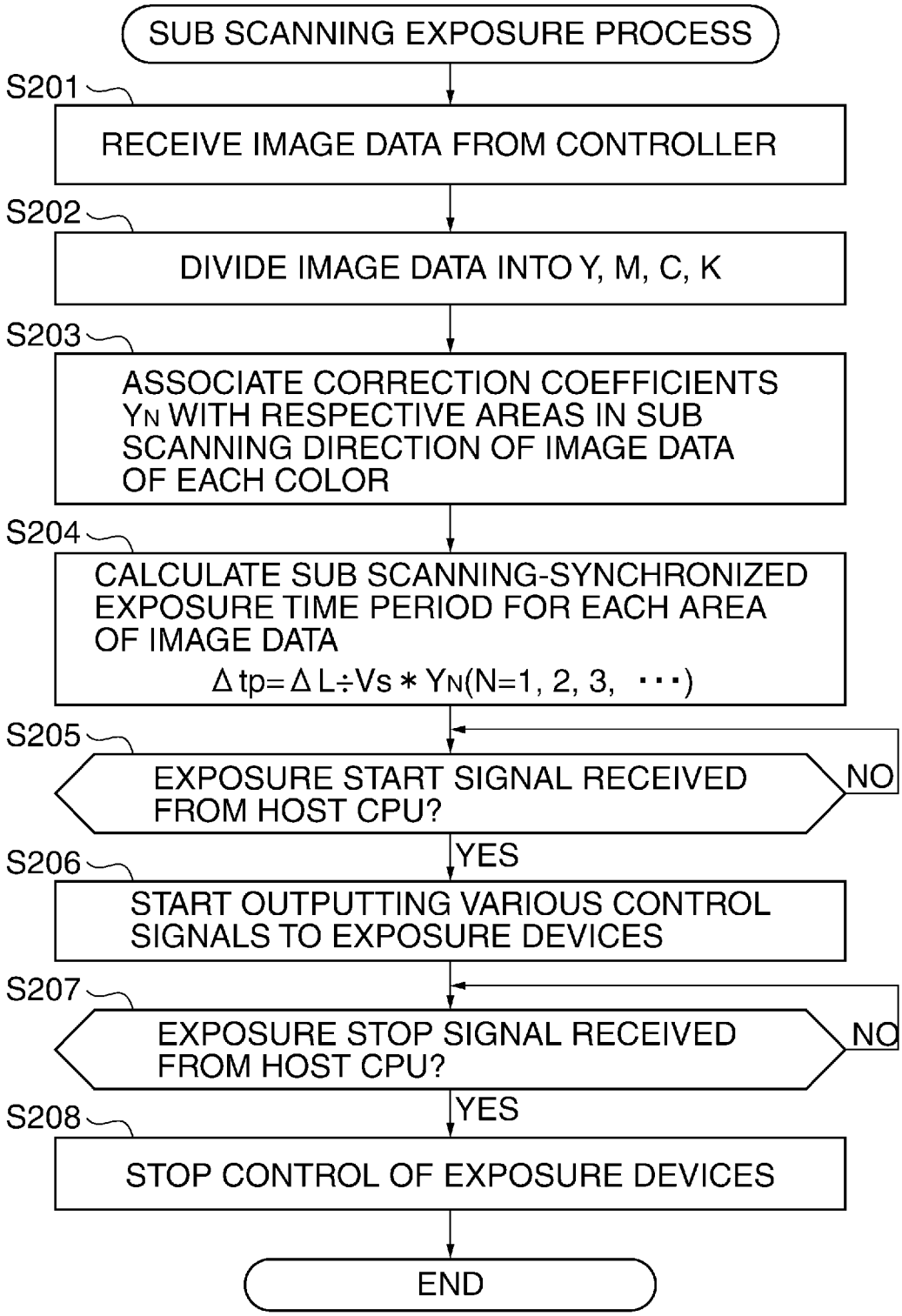
FIG. 24 is a flowchart of a sub scanning exposure process in the first embodiment.

FIG. 24 is a flowchart of the sub scanning exposure process in which the correction value for an off-center component of the drum shaft is taken into account. This sub scanning exposure process is executed by the ASIC 50 (see FIG. 12) executing a sub scanning exposure process program.

Referring to FIG. 24, when the controller 60 (see FIG. 12) receives a print operation command from a user interface of the image forming apparatus 200, or from a PC or the like, the controller 60 outputs a command signal for starting various process controls of the image forming apparatus 200 to the host CPU 1. At this time, the ASIC 50 receives image data from the controller 60 (step S201). Then, the ASIC 50 decomposes the image data into information items of the respective colors of Y, M, C, and K for controlling the associated exposure devices 101 (step S202).

Then, the ASIC 50 having decomposed the image data associates the correction coefficients $Y_N$ calculated by the drum shaft off-center component calculation process with image data items of each color corresponding to respective areas of the surface of the photosensitive drum 100 in the sub scanning direction (step S203). Note that the association of each coefficient with eat image data item is realized by a method of setting the exposure start timing to detection of the home position, and associating the first image data item in the sub scanning direction with the home position to thereby associate the image data items in the sub scanning direction with respective addresses on the photosensitive drum surface (image bearing member surface). In this case, exposure is started according to the home position detection timing for each part of image data corresponding to one sheet of the recording sheet.

Then, the ASIC 50 calculates a sub scanning exposure time period $\Delta t_p$ indicative of sub scanning synchronized exposure timing by the following equation (8) using a correction coefficient $Y_N$ associated with an address on the surface of the photosensitive drum 100, which is calculated by the correction coefficient calculation process in FIG. 18, according to the position of the image data in the sub scanning direction (step S204):

$$\Delta t_p = \Delta L \div V_s \times Y_N \quad (8)$$

wherein $\Delta t_p$: sub scanning exposure time period, $\Delta L$: target pitch distance in the sub scanning direction, $V_s$: surface speed converted from detection value by rotary encoder, $Y_N$: correction coefficient (N indicates area)

The ASIC 50 having calculated the sub scanning exposure time period determines whether or not the exposure start signal is received from the host CPU 1, and, if not, waits until the exposure start signal is detected (step S205). Upon receipt of the exposure start signal, the ASIC 50 starts to output the CLK signal and the PWM signal to the exposure device 101 (step S206). Note that the host CPU 1 delivers the exposure start timing signal at a timing at which the controller 2 detects the home position by the photosensor 7*c*.

Then, the ASIC 50 determines whether or not the exposure stop signal is received from the host CPU 1, and if not, waits until the exposure stop signal is received (step S207). Upon receipt of the exposure stop signal, the ASIC 50 stops controlling the exposure devices 101 (step S208), followed by terminating the present sub scanning exposure process. Thus, it is made possible to perform the exposure control on the photosensitive drums 100 by eliminating influence of off-centering of the drum shaft 9 has been eliminated.

According to the process in FIG. 24, since each exposure device 101 is controlled using the sub scanning-synchronized exposure time period calculated using the correction coefficient $Y_N$ associated with each area of the image data, it is possible to correct the amount of off-centering of the drum shaft 9 of the photosensitive drum 100. This makes it possible to form an electrostatic latent image on the surface of each photosensitive drum 100 with high position accuracy.

Next, a second embodiment of the present invention will be described with reference to FIG. 25.

In the present embodiment, the invention is applied to an electrophotographic color image forming apparatus, similarly to the first embodiment. The image forming apparatus according to the present embodiment has the same basic configuration as that of the image forming apparatus according to the first embodiment, including the configuration for driving the photosensitive drums (see FIG. 6), and hence description thereof is omitted.

That is, the drum shaft 9 of the photosensitive drum 100 according to the present embodiment is connected to the reduction gear shaft 8 via the coupling 9*a* as shown in FIG. 2. Further, the rotational torque from the BLDC motor 5*a* is transmitted to the photosensitive drum 100 by meshing between the motor gear 11*a* and the reduction gear 10*a* via the reduction gear shaft 8 and the drum shaft 9. The reduction gear shaft 8 and the reduction gear 10*a* are fixedly connected by a joint mechanism, not shown. Further, the rotary encoder 7A is fixedly fitted on the reduction gear shaft 8, and a detection value of the rotational speed detected by the rotary encoder 7A is used for detecting an amount of off-centering of the drum shaft 9 (reduction gear shaft 8), similarly to the first embodiment.

The photosensitive drum 100 is provided with, as control components therefor, the host CPU 1, the controller 2, the motor driver IC 3*a*, the drive circuit 4*a*, the BLDC motor 5*a*, and the rotational position sensor 6*a*.

The controller 2 receives command signals (a drive on/off signal, a target speed signal, a register setting value signal, etc.) from the host CPU 1, and outputs various control signals (a drive on/off signal and a PWM value signal, etc.) to the motor driver IC 3*a*. Angular speed feedback control based on values detected from the rotary encoders 7A is performed during print operation, and hence the controller 2 is provided with a PID controller (not shown) therein. The motor driver IC 3*a* controls, based on a control signal output from the controller 2 and a rotational position signal output from the rotational position sensor 6*a*, the drive circuit 4*a* to switch the phase currents to be supplied to the BLDC motor 5*a* and adjust the current amounts of the same.

The configuration for driving the intermediate transfer belt according to the present embodiment is the same as that for driving the intermediate transfer belt 108 according to the first embodiment, and the intermediate transfer belt is driven by the angular speed feedback control based on the output from the rotary encoder 7B arranged on the intermediate transfer belt roller shaft 12.

The present embodiment differs from the first embodiment in the method of drivingly controlling the photosensitive drum 100. That is, in the present embodiment, the result of detection of the amount of off-centering of the drum shaft 9 is reflected on the output from the rotary encoder 7A.

Hereafter, a description will be given of a method of correcting the detection value from the rotary encoder 7A using the result of detection of the amount of off-centering of the drum shaft described in the first embodiment, and controlling the photosensitive drum 100, etc., based on the corrected detection value.

First, a description will be given of a problem to be solved by the second embodiment which is caused in a case where the speed of the photosensitive drum 100 and that of the intermediate transfer belt 108 are controlled independently of each other, in advance of correction of the detection value from the rotary encoder 7A.

When the exposure control is performed using the method described in the first embodiment, the position of a toner image formed on the surface of each photosensitive drum 100 is determined with high accuracy. Further, when the photosensitive drum 100 is configured to be friction-driven by the intermediate transfer belt 108, the image is also transferred onto the intermediate transfer belt 108 in a manner ensuring the same position accuracy as that of the photosensitive drum 100. However, when the photosensitive drum 100 is not friction-driven by the intermediate transfer belt 108, a difference in surface speed is generated between the photosensitive drum 100 and the intermediate transfer belt 108 at the primary transfer section, which causes transfer position displacement in the images. When only the angular speed feedback control based on the detection value from the rotary encoder 7A is used in the control for driving the photosensitive drum 100, the surface speed difference sometimes increases. This is because, as described also in the first embodiment, it is not possible to accurately detect the surface Speed due to off-centering of the drum shaft 9.

To solve this problem, in the present embodiment, the detection value from the rotary encoder 7A is corrected so as to eliminate influence of the off-center component of the drum shaft 9 at the primary transfer position.

Figure 25:
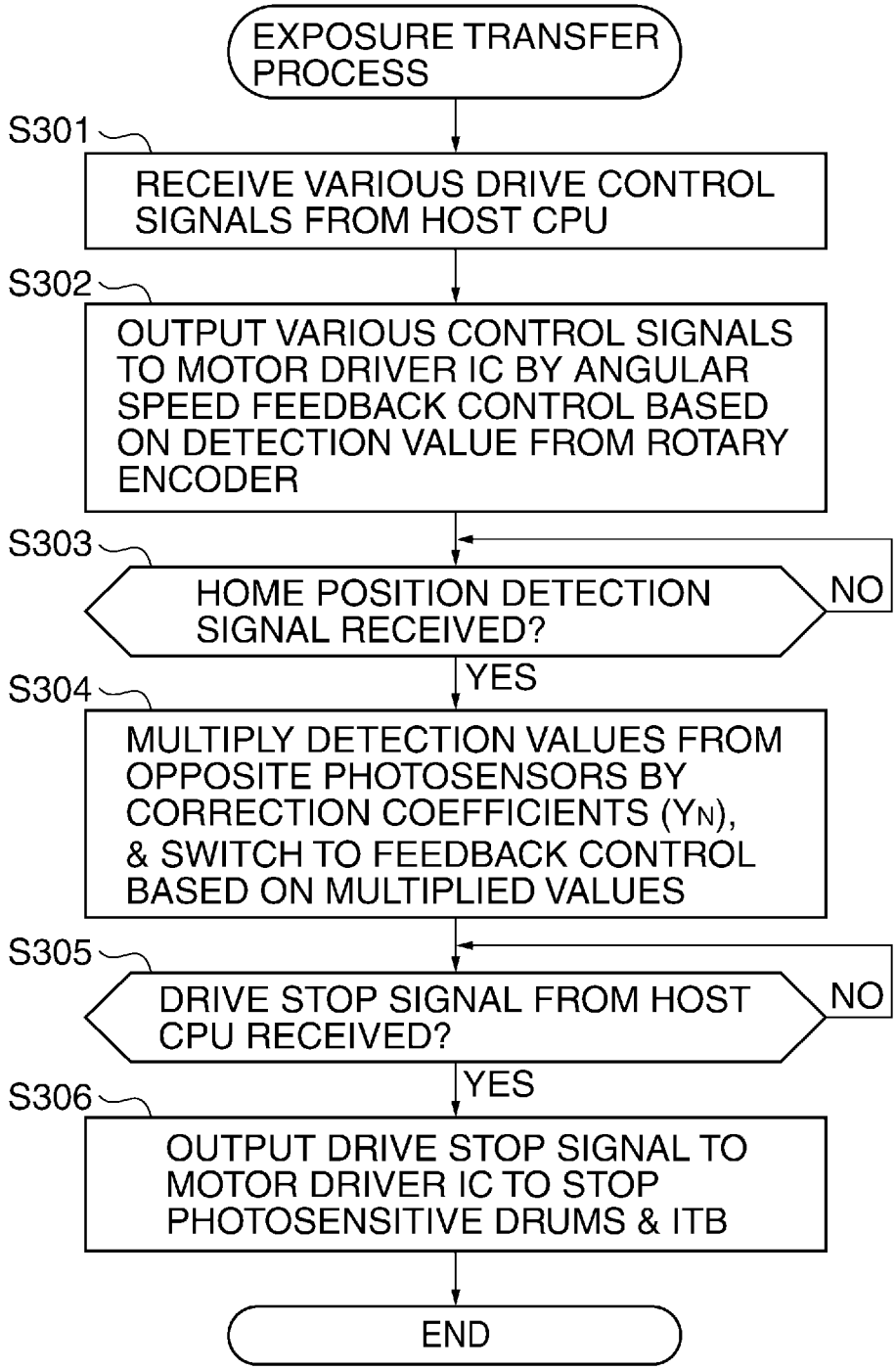
FIG. 25 is a flowchart of an exposure transfer process in a second embodiment of the present invention.

FIG. 25 is a flowchart of an exposure transfer process executed while correcting the detection value from the rotary encoder 7A based on the result of detection of the amount of off-centering of the drum shaft 9. This exposure transfer process is executed by the CPU 13 executing an exposure transfer process program.

Referring to FIG. 25, upon receipt of various control signals (a drive on signal and signals indicative of register setting values including a process speed) from the host CPU 1, the CPU 13 starts the exposure transfer process (step S301). After that, the CPU 13 outputs various control signals to the motor driver IC so as to start the angular speed feedback control of the photosensitive drums 100 and the intermediate transfer belt 108 based on the detection value from the rotary encoder 7A (step S302). Next, the CPU 13 determines whether or not a home position detection signal is received from the photosensor 7*d* (see FIG. 19), and, if not, waits until the detection signal is detected (step S303). Then, upon receipt of the home position detection signal, the CPU 13 sequentially corrects detection values (opposite-position detection values) which are output by the photosensors 7*b* and 7*c* which performs detection on diametrically opposite sides of the drum shaft 9, by multiplying the same by respective associated correction coefficients $Y_N$, and switches the speed control to the speed feedback control based on the corrected detection values (step S304). Note that the correction coefficients $Y_N$ multiplied here are retrieved from the correspondence table (correction table) (see FIG. 22) which has been prepared in the first embodiment. The photosensor 7*b* and the photosensor 7*c* are at diametrically opposite locations with respect to the drum shaft 9, and hence respective addresses of wheel slits detected by the two substantially at the same time are different from each other by 400, which is half of 800 corresponding to the total number of wheel slits around the whole circumference of the wheel 7*a* of the rotary encoder 7A. Therefore, when the address of a wheel slit 7*e* detected by the photosensor 7*b* when the home position is detected is 1, the address of a wheel slit 7*e* detected by the photosensor 7*c* is a value obtained by adding 400 to this value, i.e. 401. That is, by multiplying the respective outputs from the photosensor 7*b* and photosensor 7*c* by the correction coefficients $Y_N$ associated with the addresses 1 and 401, and then sequentially, multiplying the following outputs from the same by respective correction coefficients $Y_N$ associated with the addresses 2 and 402, 3 and 403, . . . , it is possible to relatively easily execute the correction. After that, the CPU 13 determines whether or not a drive stop signal is received from the host CPU 1, and continues driving of the photosensitive drums 100 and the intermediate transfer belt 108 until the drive stop signal is received (step S305).

After the drive stop signal is received from the host CPU 1, the CPU 13 outputs a drive stop signal to the motor driver IC to stop driving of the photosensitive drums 100 and the intermediate transfer belt 108 (step S306), followed by terminating the present sub scanning exposure process.

According to the exposure transfer process in FIG. 25, the detection value from the rotary encoder 7A is corrected based on the result of detection of the amount of off-centering of the drum shaft, and the angular speed feedback control is performed on the photosensitive drums 100 based on the corrected detection value. As a consequence, in addition to the advantageous effects provided by the first embodiment, it is possible to transfer electrostatic latent images formed on the surfaces of the respective photosensitive drums 100 onto the intermediate transfer belt 108 without displacement, by reducing generation of a difference in angular speed between the photosensitive drums 100 and the intermediate transfer belt 108.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (PAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-053399, filed Mar. 15, 2013, which is hereby incorporated by reference herein in its entirety.

What is claimed is:

1. An image forming apparatus comprising:

a photosensitive drum configured to carry a toner image;

an exposure unit configured to form an electrostatic latent image on said photosensitive drum so as to form the toner image;

a development unit configured to develop the electrostatic latent image using toner;

an intermediate transfer member configured to rotate in a state in contact with said photosensitive drum;

a speed detection unit configured to detect a rotational speed of a rotating shaft of said photosensitive drum;

an off-centering amount-detecting unit configured to detect an amount of off-centering of said rotating shaft;

a calculation unit configured to calculate a correction coefficient for correcting positional displacement of an electrostatic latent image formed on a surface of said photosensitive drum caused by off-centering of said rotating shaft; and a control unit configured to control said exposure unit to form an electrostatic latent image, which is corrected for the positional displacement caused by the off-centering of said rotating shaft, using the correction coefficient, on the surface of said photosensitive drum, wherein said off-centering amount-detecting unit includes:

a rotating member configured to be brought into contact with the surface of said photosensitive drum, and is friction-driven for rotation by rotation of said photosensitive drum, a rotation detection unit configured to detect rotation of said rotating member, and a pattern detection unit configured to detect a developed pattern formed using said development unit by developing a latent image pattern repeatedly formed on the surface of said photosensitive drum according to one revolution of said rotating member, and calculates the amount of off-centering of said rotating shaft using a detection time period during which the developed pattern is detected, a detection value output from said speed detection unit, which is associated with the detection time period, and a pitch distance of the developed pattern.

2. The image forming apparatus according to claim 1, wherein said calculation unit calculates the correction coefficient for correcting the amount of off-centering of said rotating shaft for each developed pattern on the surface of said photosensitive drum, using an average value of detection values each output from said speed detection unit in association with the developed pattern on the surface of said photosensitive drum, and the pitch distance of the developed pattern.

3. The image forming apparatus according to claim 1, wherein said control unit corrects timing of exposure to be performed by said exposure unit using the correction coefficient calculated by said calculation unit, and controls said exposure unit to form an electrostatic latent image which is corrected for the positional displacement caused by the off-centering of said rotating shaft, on the surface of said photosensitive drum based on the corrected timing of exposure.

4. The image forming apparatus according to claim 1, wherein said speed detection unit is a rotary encoder, and the detection value output from said speed detection unit is an angular speed of said rotating shaft.

5. The image forming apparatus according to claim 1 further comprising a pitch detection unit configured to detect the pitch distance of the developed pattern, wherein said pitch detection unit detects the pitch distance of the developed pattern based on changes in primary transfer current which flows from a primary transfer roller forming a primary transfer section that transfers the developed pattern on the surface of said photosensitive drum to said intermediate transfer member, to said photosensitive drum.

6. The image forming apparatus according to claim 5, wherein the developed pattern is composed of solid image portions and toner-absent portions, and said pitch detection unit detects the pitch distance of the developed pattern by detecting a point at which the primary transfer current changes from a first value corresponding to each toner-absent portion to a second value corresponding to each solid image portion adjacent to the toner-absent portion, which is smaller than the first value.

7. The image forming apparatus according to claim 1, wherein the rotational member has a function of securing a predetermined spacing between said photosensitive drum and a sleeve member of a developing device disposed in a manner opposed to said photosensitive drum.

8. The image forming apparatus according to claim 1, wherein said control unit executes feedback control for feeding back the detection value output from said speed detection unit to a drive unit that drives said photosensitive drum, said control unit correcting the detection value output from said speed detection unit using the correction coefficient, and then feeding back the corrected detection value to said drive unit of said photosensitive drum.

9. The image forming apparatus according to claim 1, wherein said photosensitive drum is friction-driven by said intermediate transfer member, and said control unit causes assist torque to be applied to said photosensitive drum for offsetting load torque acting on said photosensitive drum.

10. The image forming apparatus according to claim 1, wherein said drive unit that drives said photosensitive drum is a low-inertia DC motor.

* * * * *